US010312632B2

(12) United States Patent
Amemiya et al.

(10) Patent No.: US 10,312,632 B2
(45) Date of Patent: Jun. 4, 2019

(54) CONNECTOR

(71) Applicant: Yazaki Corporation, Tokyo (JP)

(72) Inventors: Daiki Amemiya, Tokyo (JP); Kazuto Ohtaka, Shizuoka (JP); Jun Ishikawa, Tokyo (JP); Masatoshi Nakamura, Shizuoka (JP); Sho Kawano, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/150,028

(22) Filed: Oct. 2, 2018

(65) Prior Publication Data

US 2019/0103705 A1 Apr. 4, 2019

(30) Foreign Application Priority Data

Oct. 4, 2017 (JP) ..... 2017-194196
Apr. 4, 2018 (JP) ..... 2018-072284

(51) Int. Cl.
*H01R 13/627* (2006.01)
*H01R 13/641* (2006.01)
*H01R 13/502* (2006.01)

(52) U.S. Cl.
CPC ..... *H01R 13/6272* (2013.01); *H01R 13/5025* (2013.01); *H01R 13/641* (2013.01)

(58) Field of Classification Search
CPC ..... H01R 13/6272; H01R 13/5025; H01R 13/641
USPC ..... 439/352
See application file for complete search history.

(56) References Cited

U.S. PATENT DOCUMENTS 5,163,848 A * 11/1992 Maeda ..... H01R 13/641 439/354
5,605,472 A 2/1997 Sakai et al.
5,803,651 A * 9/1998 Saito ..... H01R 13/641 403/11
5,879,180 A * 3/1999 Iwahori ..... H01R 13/641 439/352
6,908,329 B2 6/2005 Kozono et al.
(Continued)

FOREIGN PATENT DOCUMENTS

JP 8-31517 A 2/1996
JP 2002-260781 A 9/2002

*Primary Examiner* — Abdullah A Riyami
*Assistant Examiner* — Nelson R. Burgos-Guntin
(74) *Attorney, Agent, or Firm* — Kenealy Vaidya LLP

(57) ABSTRACT

A lock arm includes a pair of guide rails protruding toward side walls, extending in a detachment direction, and formed to have a part on the detachment direction side facing a direction away from a main body. A detection member includes a rib positioned on the detachment direction side of an abutment surface and positioned to be sandwiched between the main body and a locking protrusion, and is relatively movable with respect to a housing between a fixing position and the main locking position, the fixing position at which a distal end of a detection arm opposes a locking portion in the engagement direction, the locking protrusion is sandwiched between the rib and the main body while opposing the abutment surface in an insertion and removal direction, and a protruding body is positioned to oppose the part of the guide rail on the detachment direction side.

4 Claims, 16 Drawing Sheets

(56) References Cited

U.S. PATENT DOCUMENTS

| | | | | |
|---|---|---|---|---|
| 2002/0160651 | A1* | 10/2002 | Endo | H01R 13/641<br>439/489 |
| 2002/0173197 | A1* | 11/2002 | Endo | H01R 13/641<br>439/489 |
| 2003/0003792 | A1* | 1/2003 | Endo | H01R 13/6272<br>439/352 |
| 2003/0045161 | A1* | 3/2003 | Endo | H01R 13/641<br>439/489 |
| 2003/0060078 | A1* | 3/2003 | Kashiyama | H01R 13/641<br>439/489 |
| 2006/0223383 | A1* | 10/2006 | Kobayashi | H01R 13/4538<br>439/752 |
| 2012/0225574 | A1* | 9/2012 | Nakamura | H01R 13/4223<br>439/345 |

* cited by examiner

CONNECTOR

CROSS-REFERENCE TO RELATED APPLICATION(S)

The present application claims priority to and incorporates by reference the entire contents of Japanese Patent Application No. 2017-194196 filed in Japan on Oct. 4, 2017 and Japanese Patent Application No. 2018-072284 filed in Japan on Apr. 4, 2018.

BACKGROUND OF THE INVENTION

1. Field of the Invention

The present invention relates to a connector.

2. Description of the Related Art

Conventionally, in a connector, there is known a technique for allowing a worker or the like to determine whether an engagement state with a counterpart connector is complete. For example, the connector includes a detection member capable of relative movement with respect to a housing between a temporary locking position and a main locking position (see the following Japanese Patent Application Laid-open No. 2002-260781 and Japanese Patent Application Laid-open No. H8-31517). The detection member is not capable of moving from the temporary locking position to the main locking position unless the engagement state between the connector and the counterpart connector (between the connectors) is complete (is in a so-called engagement release state), but capable of moving from the temporary locking position to the main locking position if the engagement state is complete (is in a so-called complete engagement state). The worker or the like can determine whether the engagement state between the connectors is complete based on such a relative positional relationship of the detection member with respect to the housing.

Meanwhile, when locking two housings, a lock arm of a housing is elastically deformed, and a locking portion of the lock arm is caused to pass over a locked portion provided in a counterpart housing, thereby elastically restoring the lock arm. In addition, when releasing the locking between both the housings, the lock arm is operated to be elastically deformed, and both the connectors are separated to pass over the locked portion, thereby releasing the lock between the locking portion and the locked portion. In this manner, the lock arm can be bent and deformed in order to perform the lock and release of both the housings. For example, when the lock arm is in a free state without engagement of the counterpart connector, such as transport of a single connector, there is a risk that the lock arm may be plastically deformed if the lock arm deforms beyond deformation that can be elastically restored because an external force is applied or an electric wire is caught. In such a case, it is difficult for the lock arm to be elastically restored to its original state, and thus, it is difficult sufficiently secure a holding force in the engagement state after engagement of both the connectors.

SUMMARY OF THE INVENTION

The present invention has been made in view of the above description, and an object thereof is to provide a connector capable of sufficiently securing a holding force in an engagement state after engagement of both connectors.

In order to solve the above mentioned problem and achieve the object, a connector according to one aspect of the present invention includes a terminal; a housing in which the terminal is accommodated and held and to which a counterpart housing is locked by causing a locking portion to be locked by a locked portion provided in the counterpart housing to perform releasable locking when an engagement state with the counterpart connector is in a complete engagement state; and a detection member that is assembled to the housing and capable of relative movement in an engagement direction and a detachment direction with respect to the housing between a temporary locking position and a main locking position when the engagement state is the complete engagement state, wherein the housing includes: a main body; a lock wall opposing the main body in an opposing direction, which is a direction orthogonal to the engagement direction, and sandwiching the locking portion together with the main body at the main locking position; a flexible lock arm fixed to the main body; a pair of side walls erected from the main body in the opposing direction and opposing each other in an arrangement direction orthogonal to the engagement direction and the opposing direction while sandwiching the lock arm; and a pair of locking protrusions protruding from each of the side walls toward the other side wall, and the detection member is attachable to the lock arm, the lock arm includes: a locking portion; and a pair of guide rails protruding toward the side walls, respectively, extending in the detachment direction, and formed to have a part on a side in the detachment direction facing a direction away from the main body, the detection member includes: a base body; a flexible detection arm protruding from the base body in the engagement direction and positioned such that a distal end opposes the locking portion in the detachment direction at the temporary locking position and that the distal end opposes the locking portion in the engagement direction at the main locking position; a pair of wall bodies erected from the base body in the opposing direction and opposing each other in the arrangement direction; a pair of protruding bodies each of which protrudes from each of the wall bodies toward the other wall body and is positioned to be sandwiched between the main body and the guide rail when the detection member is attached to the lock arm; an abutment surface provided on a side of the detection member in the detachment direction and orthogonal to the engagement direction; and a rib positioned on a side in the detachment direction of the abutment surface, positioned to be sandwiched between the main body and the locking protrusion at the main locking position as viewed from the engagement direction, and positioned to be sandwiched between the main body and the locking protrusion at the temporary locking position, at least a part of the detection member is positioned between the lock wall and the locking portion at the main locking position, and the detection member is relatively movable with respect to the housing between a fixing position and the main locking position at least before the engagement state becomes the complete engagement state, the fixing position at which the distal end of the detection arm opposes the locking portion in the engagement direction, the locking protrusion is sandwiched between the rib and the main body while opposing the abutment surface in an insertion and removal direction, and the protruding body is positioned to oppose the part of the guide rail on the side in the detachment direction.

According to another aspect of the present invention, in the connector, it is preferable that the guide rail has an inclined portion that faces a direction away from the main body as the part on the side in the detachment direction proceeds in the detachment direction.

According to still another aspect of the present invention, in the connector, it is preferable that the lock arm includes a locked body positioned to be sandwiched between the main body and the locking protrusion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, examples of a connector according to the present invention will be described in detail with reference to the drawings. Incidentally, the invention is not limited by the examples.

Embodiment

An X direction in FIGS. 1 to 16 is an insertion and removal direction of a connector 1 and a counterpart connector C in the present embodiment, and is a front-rear direction of a housing 20 and a counterpart housing Ch. A Y direction is an arrangement direction of both the connectors in the present embodiment, is orthogonal to the insertion and removal direction, and is a width direction of the housing 20 and the counterpart housing Ch. A Z direction is a vertical direction of both the connectors in the present embodiment, and is a direction orthogonal to the insertion and removal direction and the arrangement direction. An X1 direction is an engagement direction of the connector 1 and an X2 direction is a detachment direction of the connector 1. A Z1 direction is an upward direction of both the connectors and a Z2 direction is a downward direction of both the connectors. Each direction used in the following description indicates a direction in a state where the respective parts are assembled to each other unless otherwise specified.

Figure 1:
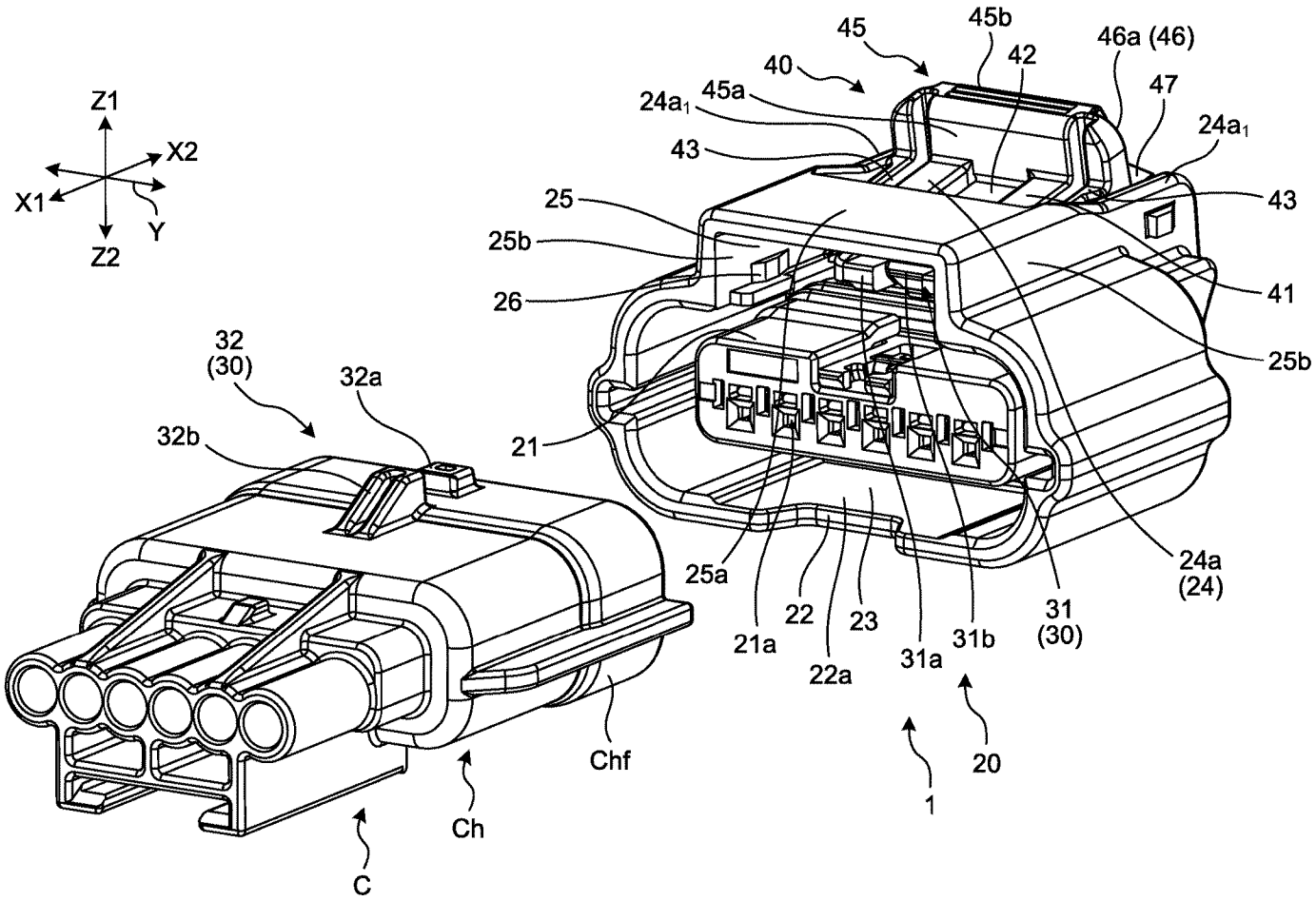
FIG. 1 is a perspective view illustrating a connector according to an embodiment and is the view illustrating a state before engagement with a counterpart connector.

The connector 1 according to the present embodiment illustrated in FIG. 1 is applied to, for example, a wire harness that is used in an automobile or the like. Here, the connector 1 is a connection mechanism for wire-to-wire connection that connects a plurality of electric wires constituting a wire harness, and is used in, for example, an air bag circuit. The connector 1 includes a terminal (not illustrated) and the housing 20 that accommodates and holds the terminal.

The terminal is molded in a predetermined shape using a conductive material such as metal, and a core wire of the terminal of the electric wire is physically and electrically connected in a predetermined connection mode such as crimping and welding. The terminal has a terminal connection portion to which a counterpart terminal of the counterpart connector C is connected and an electric wire connection portion to which the core wire of the electric wire is connected. In the present embodiment, the terminal of the connector 1 is molded as a female terminal, and the counterpart terminal of the counterpart connector C is molded as a male terminal. However, any of the terminal and the counterpart terminal may be the female terminal or the male terminal as long as the terminals are connected to each other physically and electrically upon being engaged with each other.

Figure 2:
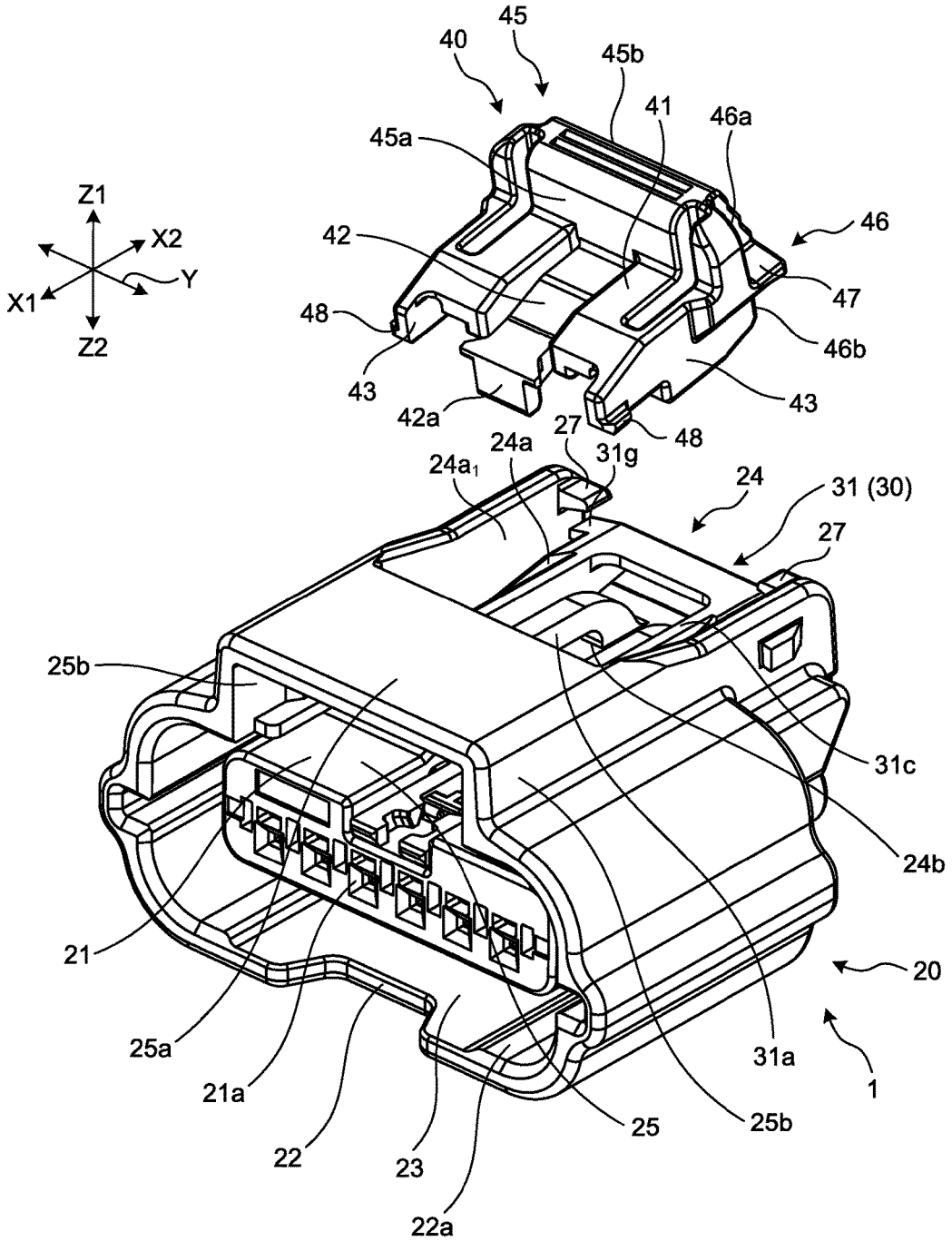
FIG. 2 is an exploded perspective view illustrating the connector according to the embodiment.
Figure 3:
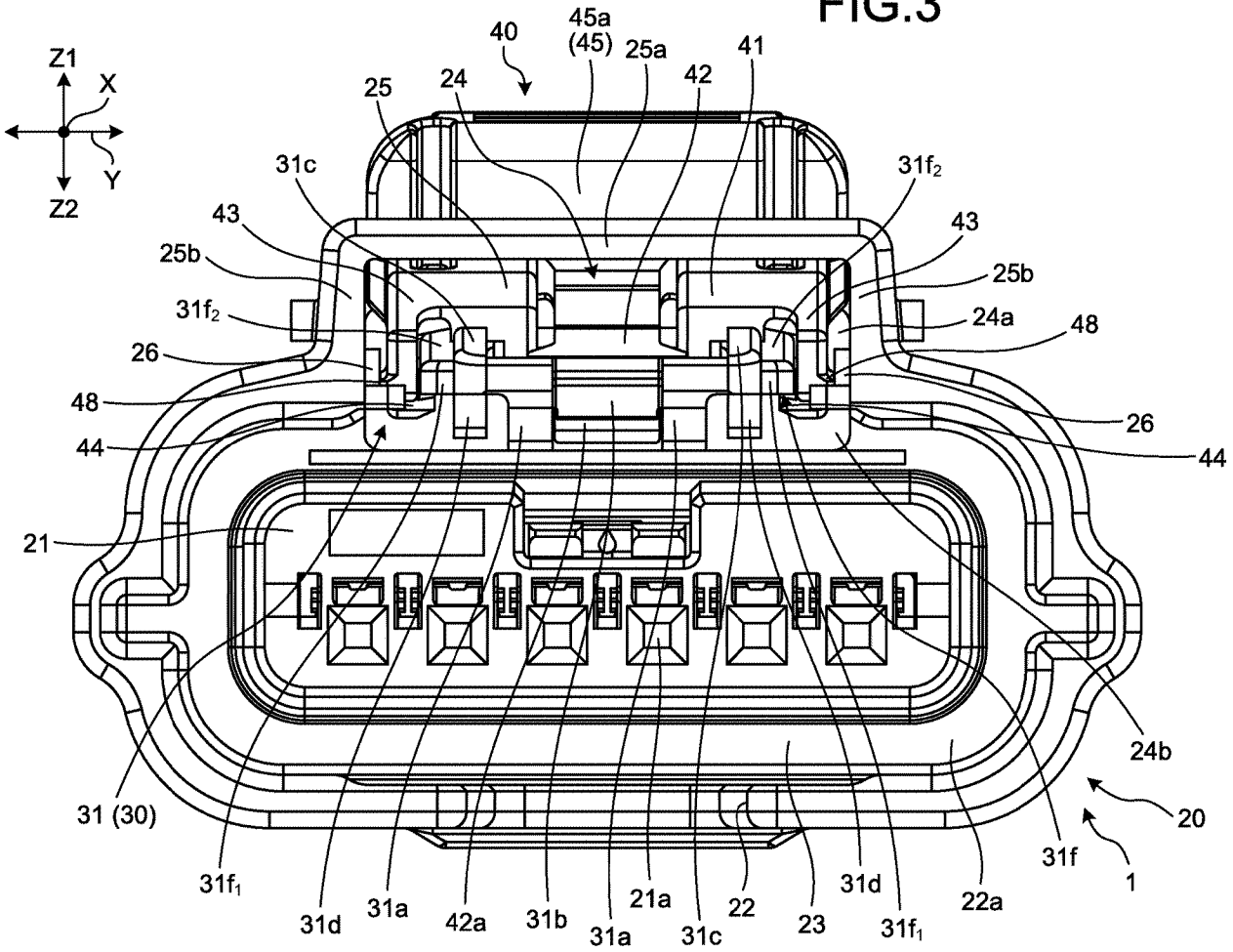
FIG. 3 is a front view of the connector according to the embodiment when viewed from the counterpart connector side.

As illustrated in FIGS. 2 and 3, the housing 20 is molded in a predetermined shape using an insulating material such as a synthetic resin, and includes a main body 21, a hood 22, an annular space 23, an operation groove 24, an accommodating space 25, a locking body 26, and a locking protrusion 27.

Figure 4:
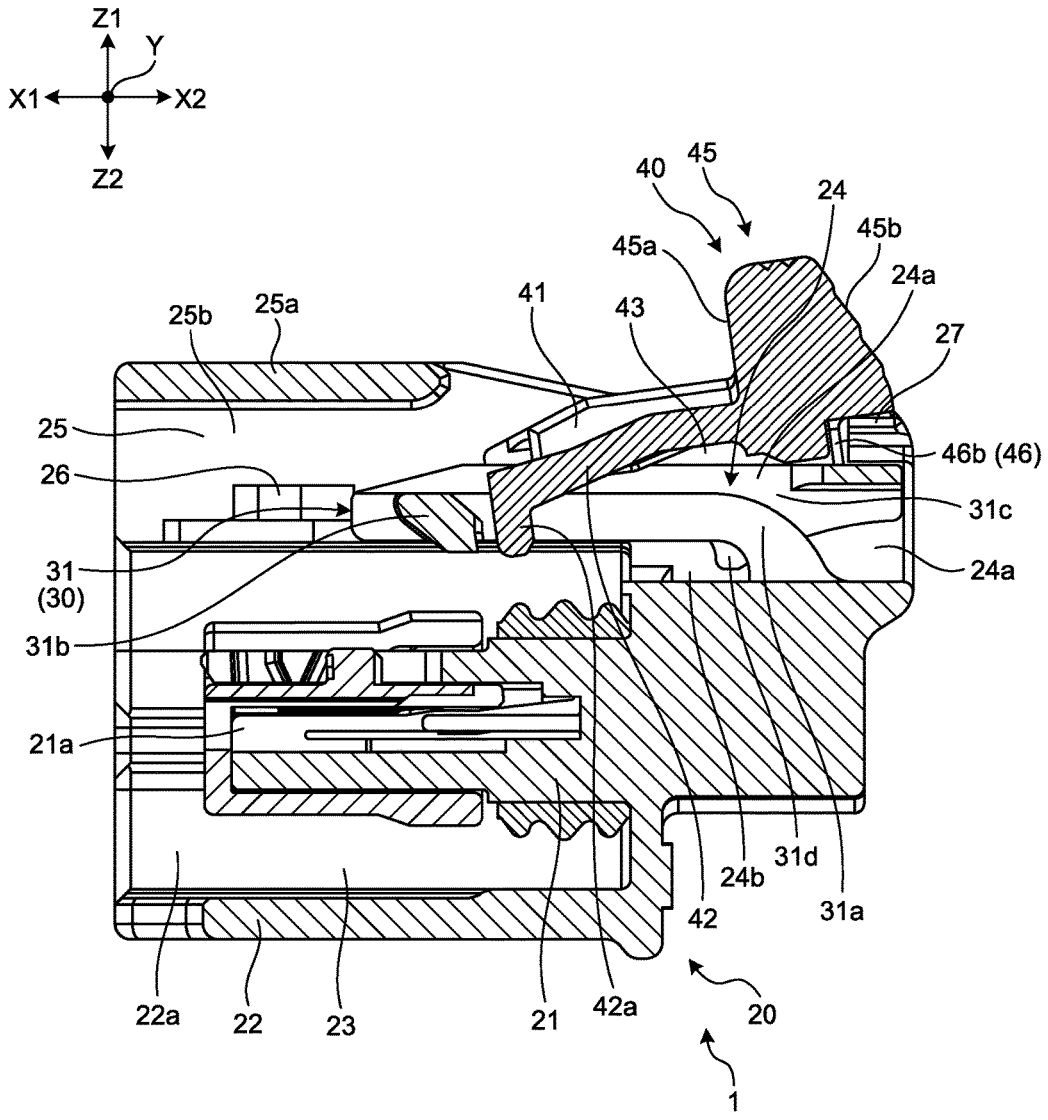
FIG. 4 is a cross-sectional view taken along a line X-X of FIG. 3.
Figure 5:
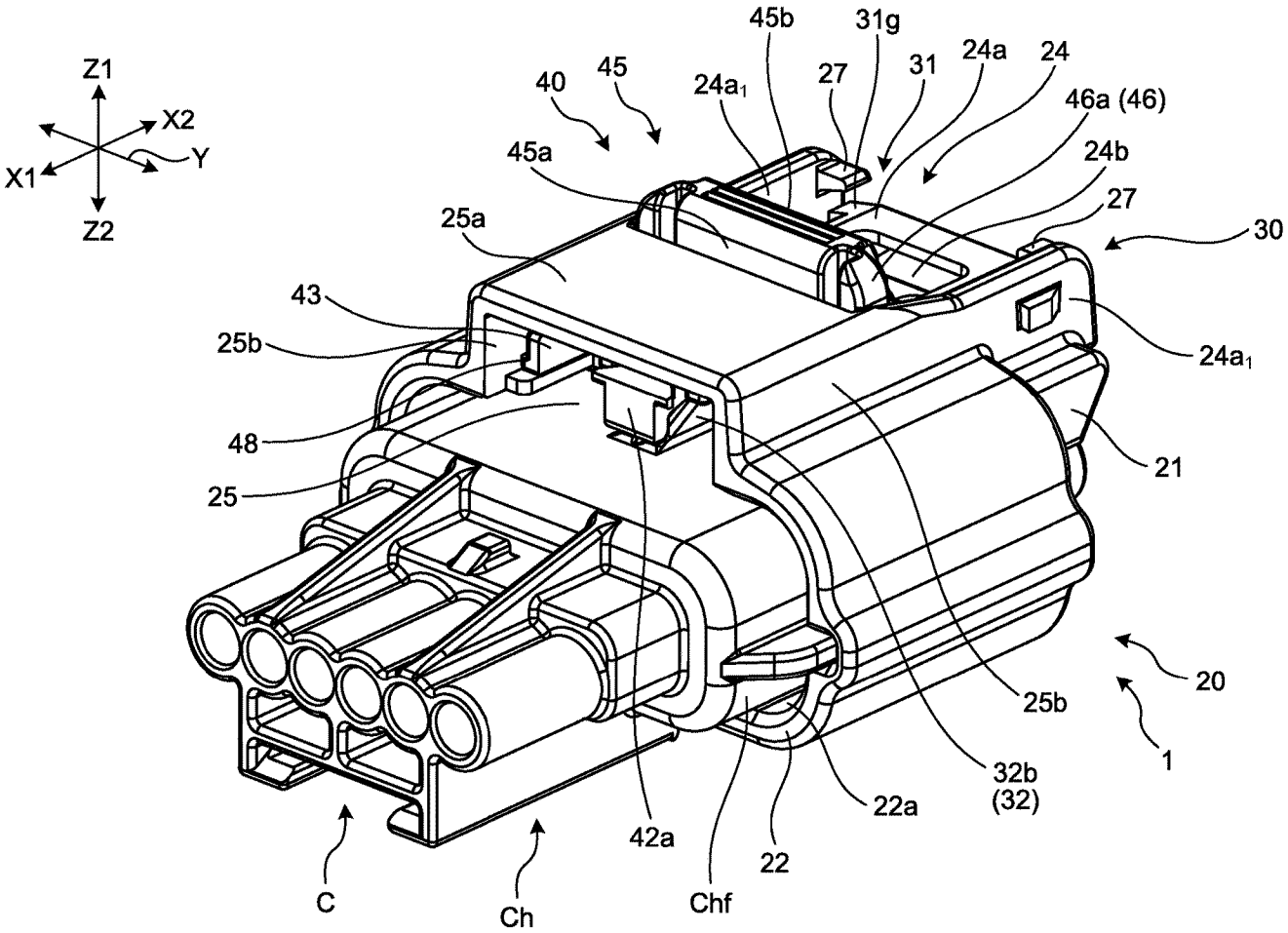
FIG. 5 is a perspective view illustrating the connector according to the embodiment and is the view illustrating a complete engagement state after completion of engagement with the counterpart connector.

As illustrated in FIG. 4, the main body 21 is provided with a plurality of terminal accommodating chambers 21*a* to accommodate and hold the plurality of terminals. Each of the terminal accommodating chambers 21*a* accommodates and holds the terminals one by one, and is formed so as to accommodate and hold the terminals one by one along the insertion and removal direction. The terminal accommodating chamber 21*a* has an opening on the engagement direction side, and the terminal connection portion of the terminal at the inner side is exposed outward through the opening. In a connector engagement process, the counterpart terminal is inserted into the terminal accommodating chamber 21*a* from the opening and is engaged with the terminal connection portion of the terminal. The terminal accommodating chamber 21*a* also has an opening on the detachment direction side, and the electric wire connected to the electric wire connection portion of the terminal at the inner side is drawn outward through the opening on the detachment direction side. The respective terminal accommodating chambers 21*a* of the present embodiment are arranged side by side in a lattice shape inside the rectangular parallelepiped main body 21 arranged inside the rectangular-tube-shaped hood 22 and protrude from the hood 22 toward the detachment direction.

As illustrated in FIGS. 1 and 2, the hood 22 has a cylindrical shape and is formed so that the main body 21 is arranged inside thereof. The hood 22 is arranged such that a cylinder axis direction thereof is along the insertion and removal direction. The hood 22 has an opening 22*a* on the engagement direction side. The counterpart connector C is inserted through the opening 22*a*. The hood 22 in the present embodiment is formed in a rectangular tube shape such that the terminal accommodating chambers 21*a* are arranged side by side in a lattice shape inside the rectangular parallelepiped main body 21 arranged at the inner side and the terminal accommodating chambers 21*a* protrude toward the detachment direction.

As illustrated in FIG. 1, the annular space 23 is formed between the main body 21 and the hood 22, a cylindrical hood Chf of the counterpart housing Ch in the counterpart connector C is accommodated so as to wrap the main body 21 at the inner side thereof in the connector engagement process between the connector 1 and the counterpart connector C. A plurality of counterpart terminals are accommodated and held inside the hood Chf.

As illustrated in FIG. 4, the operation groove 24 is formed so as to expose a part of a detection member 40, which will be described later, outward, and is provided so as to allow a worker or the like to perform an operation with respect to the detection member 40. The operation groove 24 has an operation space 24*a*, a side wall 24*a*1, and a movable space 24*b*. The operation space 24*a* is a space in which the detection member 40 is exposed outward in the operation groove 24 and is used when the worker or the like performs the operation. The operation space 24*a* has a side wall 24*a*1. The side walls 24*a*1 are formed to oppose each other in the arrangement direction, and forms a part of an outer wall of the housing 20. The movable space 24*b* is a space provided between the detection member 40 and an outer peripheral surface of the main body 21 in the operation groove 24 and communicates with the annular space 23 on the engagement direction side.

As illustrated in FIG. 4, the accommodating space 25 is formed so as to be arranged closer to the engagement direction side than the operation space 24*a*, and communicates with the engagement direction side of the operation space 24*a*. The accommodating space 25 has a lock wall 25*a* and a side wall 25*b*. The lock wall 25*a* is formed so as to oppose the main body 21 in the upward direction on a side opposite to a side of the annular space 23 in the vertical direction and accommodates a part of the detection member 40. The side wall 25*b* is formed so as to be connected to both ends of the lock wall 25*a*, and a pair of the side walls 25*b* is formed to oppose each other in the arrangement direction. In addition, the lock wall 25*a* and the side wall 25*b* form a part of the outer wall of the housing 20.

As illustrated in FIG. 3, the locking body 26 is erected individually from each of the pair of side walls 25*b* of the accommodating space 25, and a pair of the locking bodies 26 is formed to oppose each other in the arrangement direction. One of the locking bodies 26 is formed to protrude toward the other locking body 26.

As illustrated in FIG. 2, the locking protrusion 27 is erected individually from each of the pair of side walls 24*a*1 of the operation space 24*a*, and a pair of the locking protrusions 27 is formed so as to oppose each other in the arrangement direction. One of the locking protrusions 27 protrudes toward the other locking protrusion 27. The locking protrusions 27 according to the present embodiment are formed on the upward direction side at an end on the detachment direction side out of the both ends in the insertion and removal direction of the side wall 24*a*1.

Here, a state where the connector 1 and the counterpart connector C have been completely inserted into each other and the physical and electrical connection between the terminal and the counterpart terminal is established will be referred to as a complete engagement state. On the other hand, an engagement state between the connector 1 and the counterpart connector C (hereinafter also referred to as "between connectors") until the complete engagement state is formed in the connector engagement process or after the complete engagement state in a connector release process will be referred to as an engagement release state.

Figure 6:
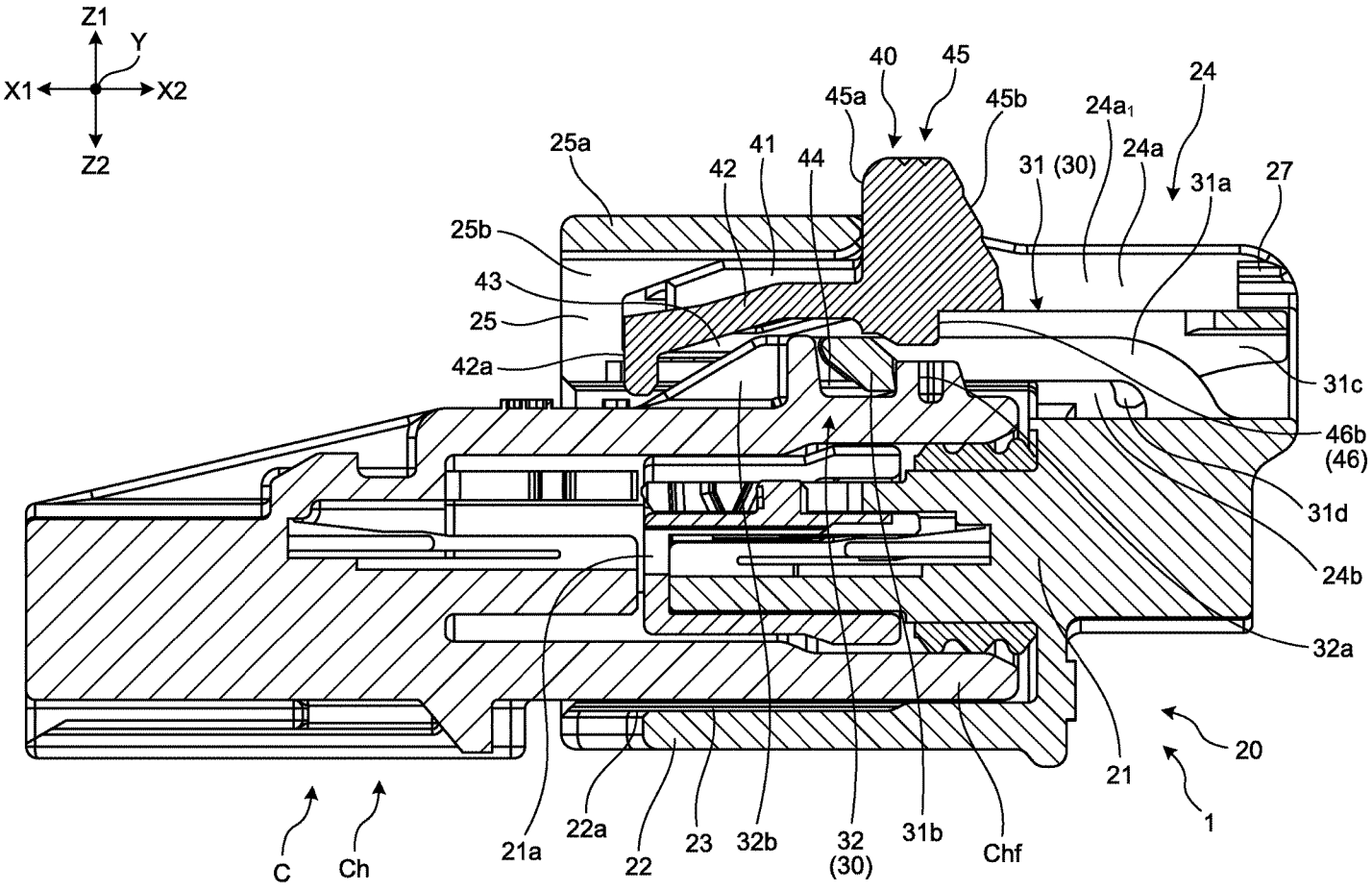
FIG. 6 is a cross-sectional view taken along a line Y-Y of FIG. 5.

As illustrated in FIG. 6, a holding structure 30, which causes the housing 20 and the counterpart housing Ch to be engaged with each other in the complete engagement state of the connector 1 and the counterpart connector C and holds the complete engagement state, is provided between the connector 1 and the counterpart connector C. The holding structure 30 is a so-called lock structure between connectors, and causes the housing 20 and the counterpart housing Ch to be engaged with each other when the engagement state between the connector 1 and the counterpart connector C is the complete engagement state and holds the complete engagement state as illustrated in FIG. 6. The holding structure 30 is formed of a lock arm 31 and a locked structure 32.

As illustrated in FIG. 4, the lock arm 31 is formed so as to be integrated with one of four outer peripheral surfaces of the main body 21, and holds the complete engagement state by being locked by the counterpart housing Ch. The lock arm 31 is formed such that the pair of side walls 24*a*1 sandwich the lock arm. In addition, the lock arm 31 is fixed to the main body 21, has flexibility, and allows the detection member 40 to be attached thereto. In addition, the lock arm 31 includes a base portion 31*a*, a locking portion 31*b*, a release lever portion 31*c*, a support portion 31*d*, a guide portion 31*f*, and a lock arm protruding body 31*g*.

The base portion 31*a* is formed such that one end on the detachment direction side is curved downward and fixed to the outer peripheral surface of the main body on the upward direction and the other end on the engagement direction side extends in the engagement direction.

The locking portion 31*b* is formed at the other end of the base portion 31*a* on the engagement direction side and is formed to oppose the lock wall 25*a* in the downward direction. The locking portion 31*b* locks a locked portion 32*a* provided in the counterpart housing Ch and locks the counterpart housing Ch to the housing 20 such that the locking therebetween can be released.

The release lever portion 31*c* is formed such that one end on the engagement direction side is connected to the locking portion 31*b* and the other end on the detachment direction side extends in the detachment direction. The release lever portion 31*c* is formed in a half arrowhead shape in which both side walls of the lock arm 31 extend in the engagement direction, and forms these side walls. In addition, the release lever portion 31*c* has the support portion 31*d*.

A gap is formed between the support portion 31*d* and the main body 21 in a state of the housing 20 alone. The support portion 31*d* opposes the outer peripheral surface of the main body 21 in the vertical direction and is formed so as to overlap one end of the base portion 31*a* on the detachment direction side when viewed from the arrangement direction.

Figure 7:
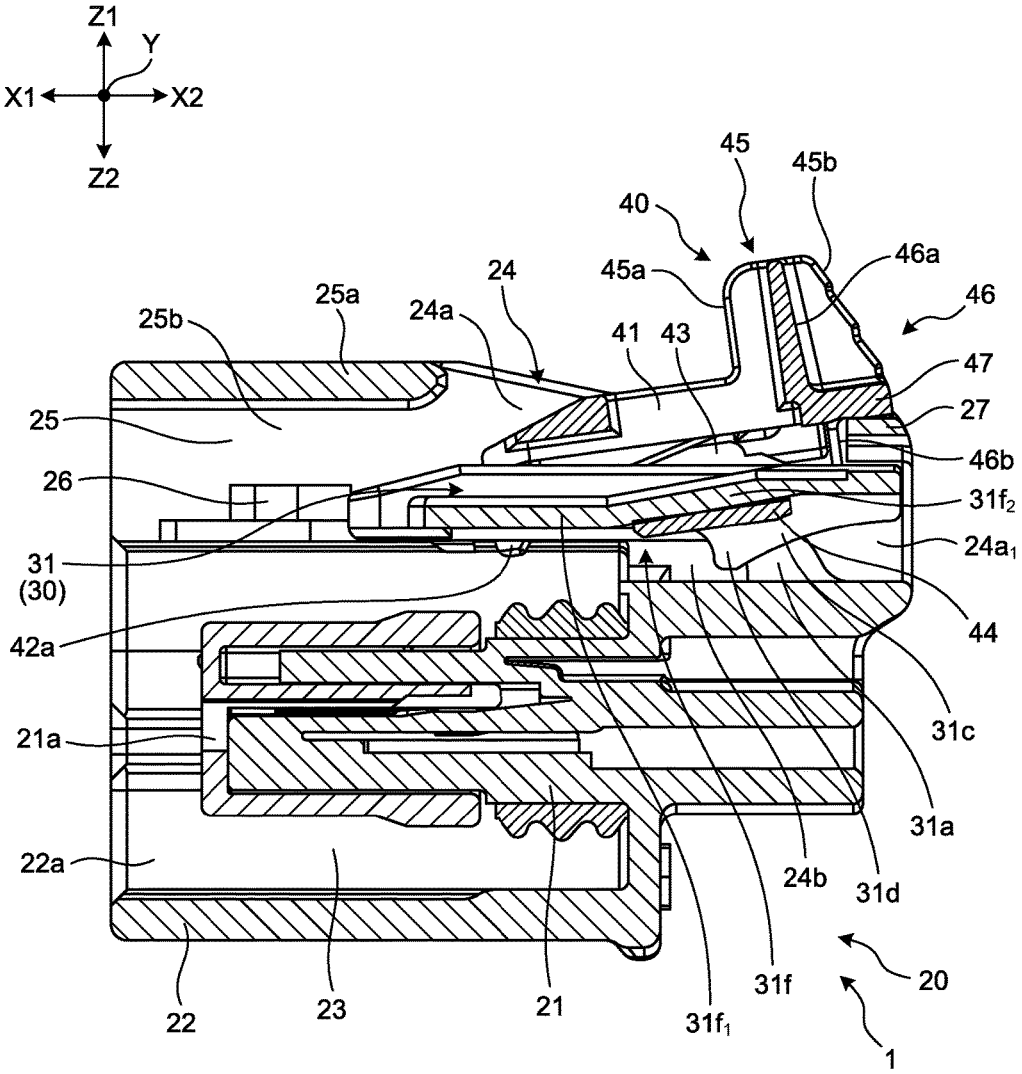
FIG. 7 is a cross-sectional view taken along a line X1-X1 of FIG. 3.

As illustrated in FIG. 7, guide rails 31*f* protrude toward the side walls 24*a*1, respectively, and extend in the detachment direction, and a part thereof on the detachment direction side is formed toward the direction away from the main body 21. A pair of the guide rails 31*f* according to the present embodiment is provided at positions opposing the side walls 24*a*1 of the release lever portion 31*c*, respectively. In addition, the guide rail 31*f* has a straight portion 31*f*1 and an inclined portion 31*f*2.

As illustrated in FIG. 7, the straight portion 31*f*1 is a part of the guide rail 31*f* on the engagement direction side and is formed so as to extend in parallel with the detachment direction.

As illustrated in FIG. 7, the inclined portion 31*f*2 is a part of the guide rail 31*f* on the detachment direction side, extends from an end of the straight portion 31*f*1 on the detachment direction side, and is formed to face the direction away from the main body 21 as proceeding in the detachment direction.

As illustrated in FIG. 2, the locked body 31*g* is positioned so as to be sandwiched between the main body 21 and the locking protrusion 27, and is erected individually from the pair of side walls 24*a*1, and a pair of the locked bodies 31*g* is formed so as to oppose each other in the arrangement direction. The locked body 31*g* is formed in a rectangular parallelepiped shape. The locked body 31*g* according to the present embodiment is formed at an end of the release lever portion 31*c* on the detachment direction side.

The locked structure 32 is provided in the counterpart housing C and is formed so as to be releasably locked by being locked by the locking portion 31*b*. The locked structure 32 has the locked portion 32*a* and a release operating portion 32*b*.

As illustrated in FIG. 1, the locked portion 32*a* is a protruding body that protrudes from the outer wall surface of the hood Chf, and is formed so as to be capable of facing the locking portion 31*b* in the insertion and removal direction in the connector engagement process. The locked portion 32*a* is formed on the outer wall surface of the hood Chf so as to be positioned on the detachment direction side of the locking portion 31*b* in the complete engagement state. The locking portion 31*b* and the locked portion 32*a* may come into contact with each other in the insertion and removal direction in the complete engagement state, or may be arranged with an interval therebetween in the insertion and removal direction. However, when the interval is provided, the interval is set such that the complete engagement state is not damaged when the interval is shortened and the locking portion 31*b* and the locked portion 32*a* come into contact with each other. The locked portion 32*a* in this example is formed in a rectangular parallelepiped shape.

As illustrated in FIG. 1, the release operating portion 32*b* is a protruding body that protrudes from the outer wall surface of the hood Chf, and is formed so as to be capable of facing the locking portion 31*b* in the insertion and removal direction in the connector engagement process. The release operating portion 32*b* is formed on the outer wall surface of the hood Chf so as to be positioned on the engagement direction side of the locking portion 31*b* in the complete engagement state. The locking portion 31*b* and the release operating portion 32*b* may come into contact with each other in the insertion and removal direction in the complete engagement state, or may be arranged with an interval therebetween in the insertion and removal direction. The release operating portion 32*b* in this example is formed in a rectangular parallelepiped shape, and has an inclined surface formed on the engagement direction side.

As illustrated in FIG. 7, the connector 1 according to the present embodiment includes the detection member 40 which is formed so as to be relatively movable with respect to the housing 20 in the insertion and removal direction and configured to allow the worker or the like to determine the complete engagement state with the counterpart connector C. The detection member 40 is attached to the lock arm 31. The detection member 40 is assembled with the housing 20 so as to be arranged closer to the outside of the housing 20 than the lock arm 31 and at least the detachment direction side is arranged in the operation space 24*a* of the operation groove 24. Therefore, at least the detachment direction side of the detection member 40 is exposed to the outside in the operation space 24*a*. In the connector 1 of the present embodiment, the operation space 24*a* is also used as a space for the relative movement operation of the detection member 40. Thus, the detachment direction side of the detection member 40 is used as an operating portion for the relative movement operation. In addition, the detection member includes a base body 41, a detection arm 42, a wall body 43, a protruding body 44, a detection member operating portion 45, an abutment surface 46, a rib 47, and a locking protrusion 48 for main locking.

As illustrated in FIG. 4, the base body 41 is formed so as to be arranged with an interval with respect to the base portion 31*a* of the lock arm 31 after attaching the detection member 40 to the housing 20. For example, as illustrated in FIG. 8, the base body 41 may be a rectangular piece-shaped molded body having one flat surface facing the base portion 31*a* in the downward direction, and may be one obtained by forming various notches, grooves, and the like in the piece-shaped molded body.

Figure 8:
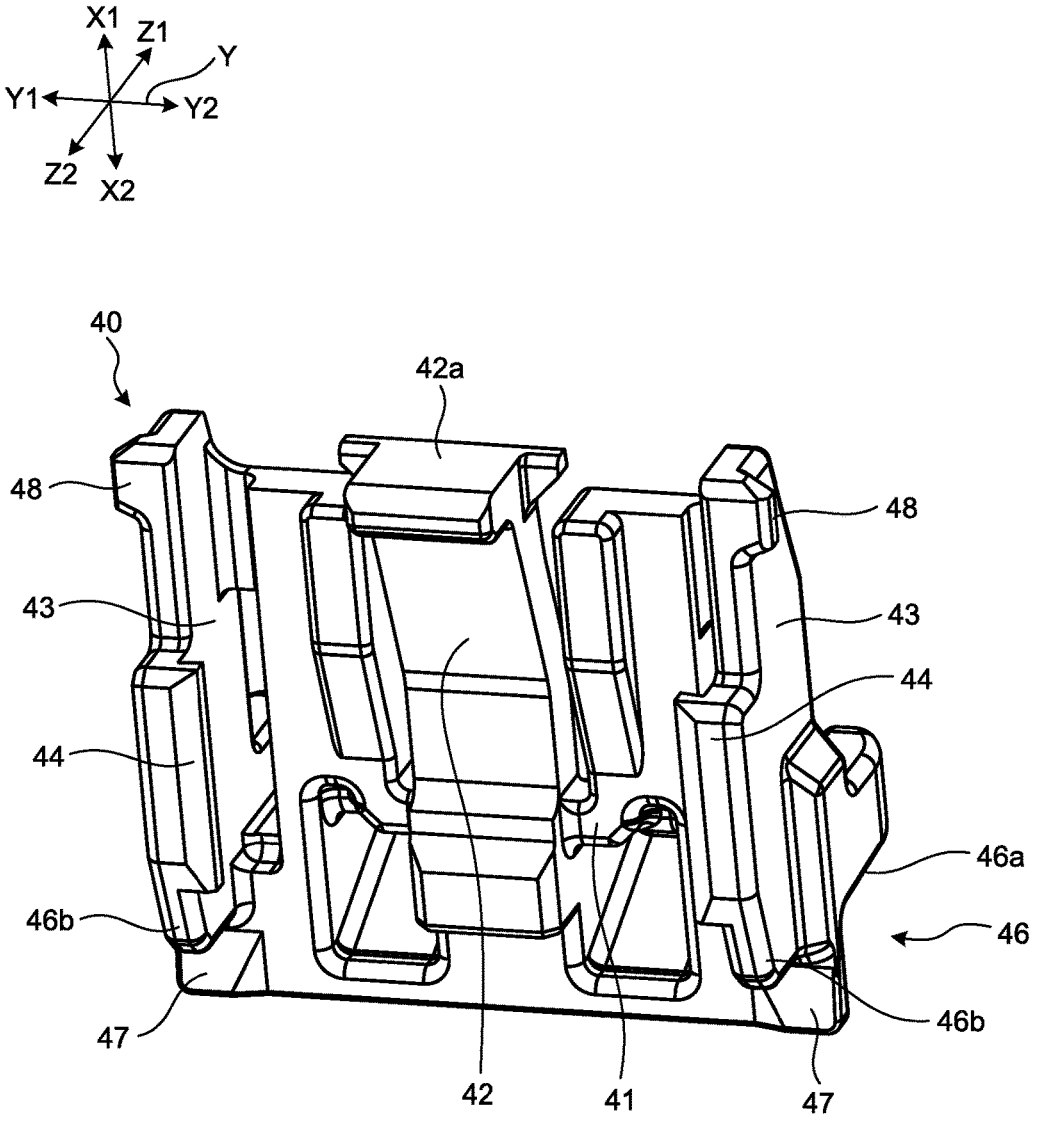
FIG. 8 is a perspective view illustrating a detection member according to the embodiment.

As illustrated in FIG. 8, the detection arm 42 is formed so as to protrude in the engagement direction from the center in the arrangement direction of the base body 41 formed in a U shape and to have flexibility with respect to the base body 41. The detection arm 42 has a distal end 42*a*, and is formed such that the distal end 42*a* opposes the locking portion 31*b* in the insertion and removal direction when the detection member 40 is attached to the lock arm 31.

As illustrated in FIG. 8, a pair of the wall bodies 43 is formed to be erected in opposing direction from both ends of the base body 41 in the arrangement direction. The wall bodies 43 are formed toward the side walls 24*a*1, respectively, and are formed so as to oppose each other in an aligned direction. Each of the wall bodies 43 has the protruding body 44. The protruding body 44 is formed so as to protrude from each of the wall bodies 43 toward the wall body 43. The protruding body 44 according to the present embodiment is formed at an end of the wall body 43 on the downward direction side, and is formed and arranged to face to the guide rail 31*f* of the lock arm 31 in the arrangement direction in a detection member movement process. The protruding body 44 guides relative movement of the detection member 40 with respect to the housing 20 in the insertion and removal direction by moving in the insertion and removal direction while opposing the guide rail 31*f* in the vertical direction.

As illustrated in FIG. 1, the detection member operating portion 45 is formed so as to protrude from the base body 41 in the upward direction in the operation space 24*a*. The detection member operating portion 45 is used when a worker or the like performs relative movement of the detection member 40. The detection member operating portion 45 protrudes outward from the lock wall 25*a* of the housing 20 and has a release operation surface 45*a* and an engagement operation surface 45*b*. The release operation surface 45*a* is positioned on the engagement direction side and is formed to face the detachment direction, and the engagement operation surface 45*b* is positioned on the detachment direction side and is formed to face the engagement direction. The detection member operating portion 45 is formed so as to oppose the main body 21 with the support portion 31*d* sandwiched therebetween and to be positioned on the detachment direction side of the locking portion 31*b* at the temporary locking position.

As illustrated in FIG. 7, the abutment surface 46 is a plane orthogonal to the engagement direction when the detection member 40 is attached to the lock arm 31, and is formed so as to oppose each of the locking protrusions 27 from the engagement direction side. A pair of the abutment surfaces 46 according to the present embodiment is formed to sandwich the detection member operating portion 45 in the arrangement direction. Each of the abutment surfaces 46 has a temporary locking abutment surface 46*a* and a fixing abutment surface 46*b*.

As illustrated in FIG. 7, the temporary locking abutment surface 46*a* is a part of the abutment surface 46 on the upward direction side and is formed so as to extend in the upward direction. A pair of the temporary locking abutment surfaces 46*a* according to the embodiment is formed so as to sandwich the detection member operating portion 45 in the arrangement direction.

As illustrated in FIG. 7, the fixing abutment surface 46*b* is a part of the abutment surface 46 on the downward direction side and is formed so as to extend in the downward direction. A pair of the fixing abutment surfaces 46*b* according to the embodiment is positioned on the detachment direction side of the respective wall bodies 43, and is formed to be orthogonal to the engagement direction.

As illustrated in FIG. 7, the rib 47 is positioned on the detachment direction side of each of the abutment surfaces 46 and is provided so as to extend in the detachment direction from a midway position in an opposing direction of the respective abutment surfaces 46. The pair of ribs 47 according to the present embodiment is formed to sandwich the detection member operating portion 45 in the arrangement direction. The ribs 47 are formed to extend in the detachment direction, respectively, from ends of the temporary locking abutment surfaces 46*a* on the downward direction side, and to be positioned on the upward direction side of the temporary locking abutment surfaces 46*a* when viewed from the detachment direction.

As illustrated in FIG. 2, the locking protrusion 48 for main locking is formed in each of the wall bodies 43 of the detection member 40 on the engagement direction side. The pair of locking protrusions 48 for main locking protrudes so as to oppose each of the side walls 25*b* of the housing 20, and is formed and arranged so as to be capable of facing the locking body 26 of the housing 20 in the engagement direction in the detection member movement process.

The detection member 40 can be relatively moved with respect to the housing 20 between the temporary locking position and the main locking position (the detection member movement process). The temporary locking position is a position of the detection member 40 with respect to the housing 20 when the engagement state between the connector 1 and the counterpart connector C is in the engagement release state, and is the position at which the detection member 40 is not positioned between the lock wall 25*a* and the locking portion 31*b*. The main locking position is a position of the detection member 40 with respect to the housing 20 when the engagement state between the connector 1 and the counterpart connector C is in the complete engagement state, and is the position at which at least a part of the detection member 40 is positioned between the lock wall 25*a* and the locking portion 31*b*. The detection member 40 according to the present embodiment can relatively move with respect to the housing 20 in the insertion and removal direction, reaches the main locking position by being relatively moved from the temporary locking position in the engagement direction, and reaches the temporary locking position by being relatively moved from the main locking position in the detachment direction.

Figure 10:
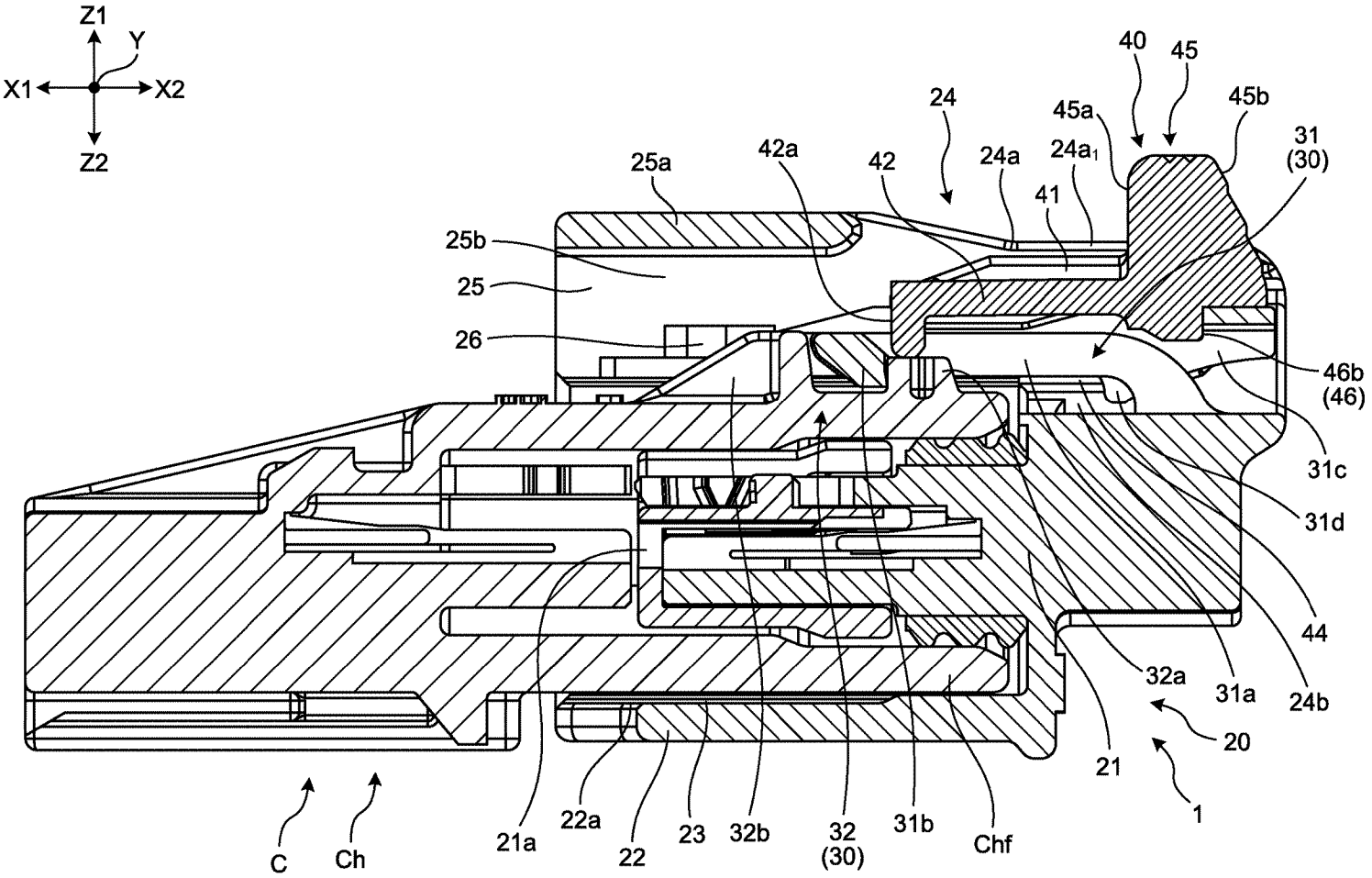
FIG. 10 is a view illustrating a state of a detection member after moving from a main locking position in FIG. 6 to a temporary locking position.
Figure 11:
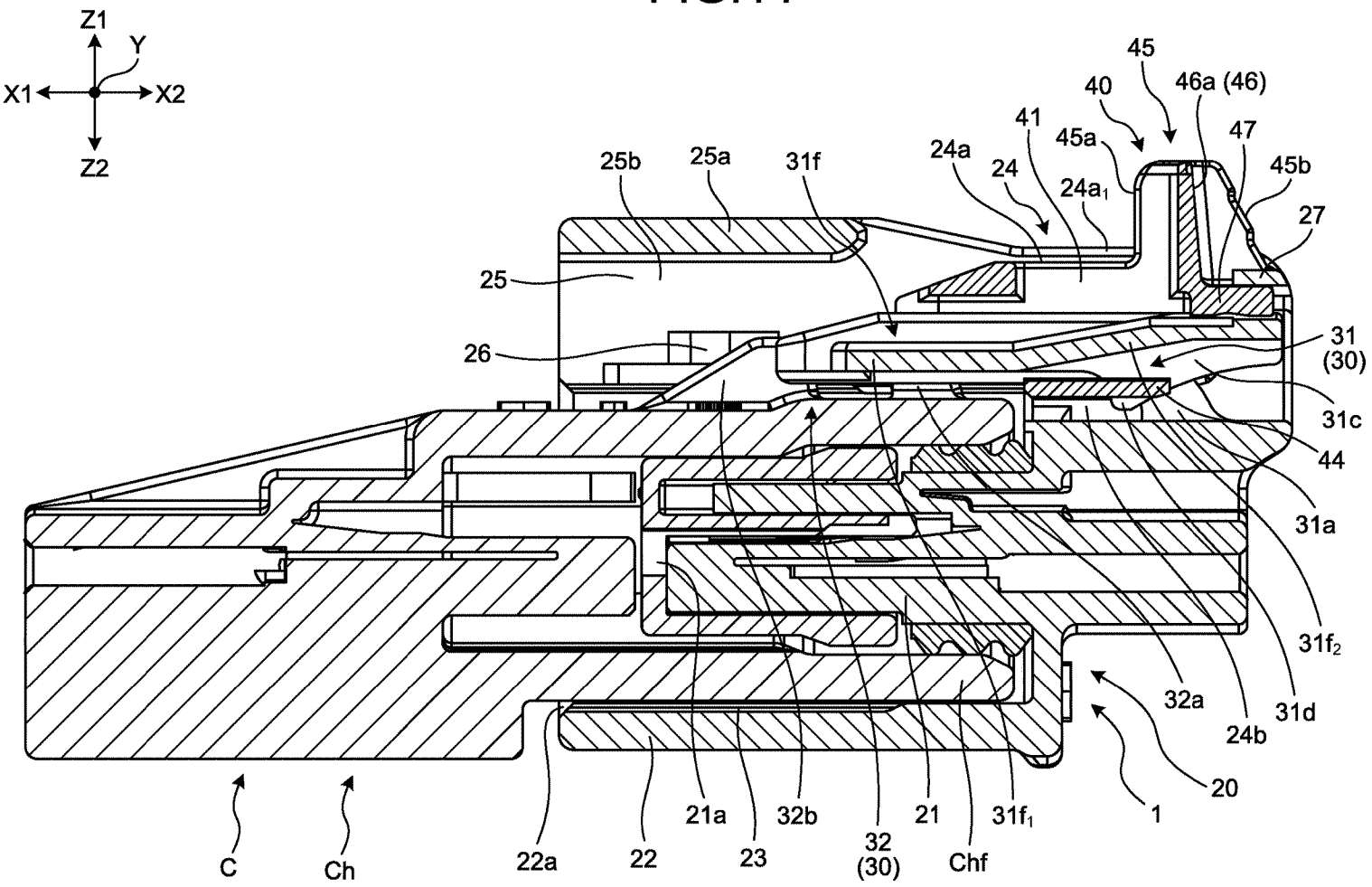
FIG. 11 is a view illustrating a state of the detection member after moving from the main locking position in FIG. 9 to the temporary locking position.
Figure 12:
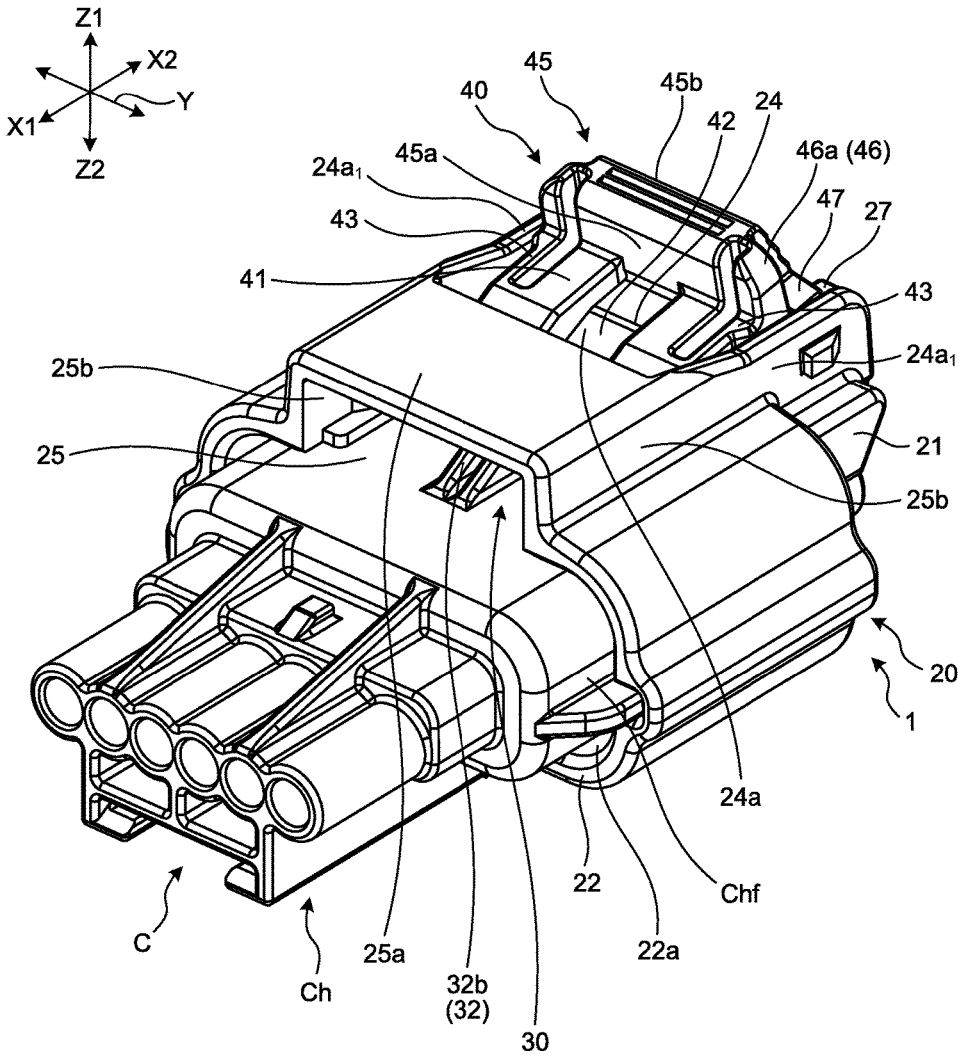
FIG. 12 is a view illustrating a state of the detection member at a fixing position.

Next, a description will be given regarding a relative movement direction and locking in the upward direction of the detection member 40 with respect to the housing 20 at the temporary locking position. As illustrated in FIGS. 10 and 11, a temporary locking structure that restricts the movement of the detection member 40 in the insertion and removal direction and the upward direction with respect to the housing 20 at the temporary locking position is provided between the detection member 40 and the housing 20. The temporary locking structure restricts the movement of the detection member 40 toward the detachment direction side by the respective temporary locking abutment surfaces 46*a* of the detection member 40 and the respective locking protrusions 27 of the housing 20, restricts the movement of the detection member 40 toward the engagement direction side by the locking portion 31*b* of the lock arm 31 and the distal end 42*a* of the detection arm 42, and restricts the movement of the detection member 40 toward the upward direction side by the respective ribs 47 of the detection member 40 and the respective locking protrusions 27 of the housing 20.

The structure in which the movement of the detection member 40 toward the detachment direction side is restricted at the temporary locking position will be described. As illustrated in FIG. 11, the locking protrusions 27 are arranged on the detachment direction side of the temporary locking abutment surfaces 46*a*, respectively, and oppose the ends on the detachment direction side of the respective temporary locking abutment surfaces 46*a* in the insertion and removal direction, whereby the movement of each of the temporary locking abutment surfaces 46*a* toward the detachment direction side is restricted by each of the locking protrusions 27. The movement of the detection member 40 toward the detachment direction side with respect to the lock arm 31 (the housing 20) at the temporary locking position is restricted by the respective temporary locking abutment surfaces 46*a* and the respective locking protrusions 27. The respective temporary locking abutment surfaces 46*a* and the respective locking protrusions 27 may come into contact with each other in the insertion and removal direction or may be arranged with an interval therebetween in the insertion and removal direction when the detection member 40 is at the temporary locking position.

The structure in which the movement of the detection member 40 toward the engagement direction side is restricted at the temporary locking position will be described. The distal end 42*a* of the detection arm 42 regulates the movement toward the engagement direction side in the accommodating space 25. As illustrated in FIG. 10, the locking portion 31*b* is arranged so as to oppose the distal end 42*a* in the insertion and removal direction, thereby restricting the movement of the distal end 42*a* toward the engagement direction side. When the detection member 40 is at the temporary locking position before the counterpart connector C is inserted, the movement of the detection member 40 toward the connector engagement direction side with respect to the lock arm 31 (the housing 20) is restricted by the locking portion 31*b* and the distal end 42*a*. At that time, the locking portion 31*b* and the distal end 42*a* may come into contact with each other in the insertion and removal direction, or may be arranged with an interval therebetween in the insertion and removal direction.

The structure in which the movement of the detection member 40 toward the upward direction side is restricted at the temporary locking position will be described. As illustrated in FIG. 11, the locking protrusions 27 are arranged on the upward direction side of the ribs 47, respectively, and oppose the ends on the upward direction side of the respective ribs 47 in the insertion and removal direction, whereby the movement of each of the ribs 47 toward the detachment direction side is restricted by each of the locking protrusions 27. The movement of the detection member 40 toward the upward direction side with respect to the lock arm 31 (the housing 20) at the temporary locking position is restricted by the respective ribs 47 and the respective locking protrusions 27. The respective ribs 47 and the respective locking protrusions 27 may come into contact with each other in the opposing direction or may be arranged with an interval therebetween in the opposing direction when the detection member 40 is at the temporary locking position.

Next, a description will be given regarding a relative movement direction and locking in the upward direction of the detection member 40 with respect to the housing 20 at the main locking position. As illustrated in FIG. 6, a main locking structure that restricts the movement of the detection member 40 in the insertion and removal direction and the upward direction with respect to the housing 20 at the main locking position is provided between the detection member 40 and the housing 20. The main locking structure restricts the movement of the detection member 40 toward the detachment direction side by the respective locking bodies 26 of the housing 20 and the respective locking protrusions 48 for main locking of the detection member 40, restricts the movement of the detection member 40 toward the insertion direction side by the detection member operating portion 45 of the detection member 40 and the lock wall 25*a* of the housing 20, and restricts the movement of the detection member 40 toward the upward direction side by the lock wall 25*a* of the housing 20 and the respective wall bodies 43 of the detection member 40.

The structure in which the movement of the detection member 40 toward the detachment direction side is restricted at the main locking position will be described. In the detection member 40, the respective locking protrusions 48 for main locking are positioned on the engagement direction side of the respective locking bodies 26, thereby forming a state where each of the locking bodies 26 and each of the locking protrusions 48 for main locking oppose each other in the insertion and removal direction. Here, the movement of each of the locking protrusions 48 for main locking toward the detachment direction side is restricted by each of the locking bodies 26. The movement of the detection member 40 toward the detachment direction side with respect to the lock arm 31 (the housing 20) at the main locking position is restricted by the respective locking bodies 26 and the respective locking protrusions 48 for main locking. At that time, the respective locking bodies 26 and the respective locking protrusions 48 for main locking may come into contact with each other in the insertion and removal direction, or may be arranged with an interval therebetween in the insertion and removal direction.

The structure in which the movement of the detection member 40 toward the insertion direction side is restricted at the main locking position will be described. As illustrated in FIG. 6, the detection member operating portion 45 is positioned on the detachment direction side of the lock wall 25*a* in the detection member 40, thereby forming a state where the lock wall 25*a* and the detection member operating portion 45 oppose each other in the insertion and removal direction. Here, the movement of the detection member operating portion 45 toward the engagement direction side is restricted by the respective lock walls 25*a*. The movement of the detection member 40 toward the engagement direction side with respect to the lock arm 31 (the housing 20) at the main locking position is restricted by the lock wall 25*a* and the detection member operating portion 45. At that time, the lock wall 25*a* and the detection member operating portion 45 may come into contact with each other in the insertion and removal direction, or may be arranged with an interval therebetween in the insertion and removal direction.

The structure in which the movement of the detection member 40 toward the upward direction side is restricted at the main locking position will be described. As illustrated in FIG. 6, the respective wall bodies 43 are positioned on the downward direction side of the lock wall 25*a* in the detection member 40, thereby forming a state where the lock wall 25*a* and each of the wall bodies 43 oppose each other in the opposing direction. Here, the movement of each of the wall bodies 43 toward the upward direction side is restricted by each of the lock walls 25*a*. The movement of the detection member 40 toward the upward direction side with respect to the lock arm 31 (the housing 20) at the main locking position is restricted by the lock wall 25*a* and the respective wall bodies 43. At that time, the lock wall 25*a* and the respective wall bodies 43 may come into contact with each other in the opposing direction, or may be arranged with an interval therebetween in the opposing direction.

In addition, the detection member 40 can be relatively moved with respect to the housing 20 between the main locking position and the fixing position. The fixing position is a position where the detection member 40 is held by the housing 20 in a state where the detection member 40 is attached to the lock arm 31 before the engagement state becomes the complete engagement state. The fixing position according to the present embodiment is also a position when the detection member 40 is assembled with the housing 20. Thus, a state before the connector 1 and the counterpart connector C are inserted to each other is also included in the fixing position.

A description will be given regarding a relative movement direction and locking in the opposing direction of the detection member 40 with respect to the housing 20 at the fixing position. As illustrated in FIGS. 4 and 7, a fixing structure that restricts the movement of the detection member 40 in the insertion and removal direction and the opposing direction with respect to the housing 20 at the main locking position is provided between the detection member 40 and the housing 20. The fixing structure restricts the movement of the detection member 40 toward the detachment direction side by the respective locking protrusions 27 of the housing 20 and the fixing abutment surfaces 46*b* of the detection member 40, restricts the movement of the detection member 40 toward the insertion direction side by the distal end 42*a* of the detection arm 42 and the locking portion 31*b* of the lock arm 31, restricts the movement of the detection member 40 toward the upward direction side by the respective inclined portions 31*f*2 of the guide rails 31*f* and the protruding bodies 44 of the respective wall bodies 43, and restrict the movement of the detection member 40 toward the upward direction side by the respective locking protrusions 27 of the housing 20 and the respective ribs 47 of the detection member 40.

The structure in which the movement of the detection member 40 toward the detachment direction side is restricted at the fixing position will be described. As illustrated in FIG. 4, the respective fixing abutment surfaces 46*b* are positioned on the engagement direction side of the respective locking protrusions 27 in the detection member 40, thereby forming a state where each of the locking protrusions 27 and each of the fixing abutment surfaces 46*b* oppose each other in the insertion and removal direction. Here, the movement of each of the fixing abutment surfaces 46*b* toward the detachment direction side is restricted by each of the locking protrusions 27. The movement of the detection member 40 toward the detachment direction side with respect to the lock arm 31 (the housing 20) at the fixing position is restricted by the respective locking protrusions 27 and the respective fixing abutment surfaces 46*b*. At that time, the respective locking protrusions 27 and the respective fixing abutment surfaces 46*b* may come into contact with each other in the insertion and removal direction, or may be arranged with an interval therebetween in the insertion and removal direction.

The structure in which the movement of the detection member 40 toward the insertion direction side is restricted at the fixing position will be described. As illustrated in FIG. 4, the distal end 42*a* is positioned on the detachment direction side of the locking portion 31*b* in the detection member 40, thereby forming a state where the locking portion 31*b* and the distal end 42*a* oppose each other in the insertion and removal direction. Here, the locking portion 31*b* restricts the movement of the distal end 42*a* toward the insertion direction side. The movement of the detection member 40 toward the insertion direction side with respect to the lock arm 31 (the housing 20) at the fixing position is restricted by the locking portion 31*b* and the distal end 42*a*. At that time, the locking portion 31*b* and the distal end 42*a* may come into contact with each other in the insertion and removal direction, or may be arranged with an interval therebetween in the insertion and removal direction.

The structure in which the movement of the detection member 40 toward the upward direction side is restricted at the fixing position will be described. As illustrated in FIG. 7, the respective protruding bodies 44 are positioned on the downward direction side of the respective inclined portions 31*f*2 in the detection member 40, thereby forming a state where each of the inclined portions 31*f*2 and each of the protruding bodies 44 oppose each other in the opposing direction. Here, the movement of each of the protruding bodies 44 toward the upward direction side is restricted by each of the inclined portions 31*f*2. The movement of the detection member 40 toward the upward direction side with respect to the lock arm 31 (the housing 20) at the fixing position is restricted by the respective inclined portions 31*f*2 and the respective protruding bodies 44. At that time, the respective inclined portions 31*f*2 and the respective protruding bodies 44 may come into contact with each other in the opposing direction, or may be arranged with an interval therebetween in the opposing direction.

The structure in which the movement of the detection member 40 toward the downward direction side is restricted at the fixing position will be described. As illustrated in FIG. 7, the respective ribs 47 are positioned on the upward direction side of the respective locking protrusions 27 in the detection member 40, thereby forming a state where each of the locking protrusions 27 and each of the ribs 47 oppose each other in the opposing direction. Here, the movement of each of the ribs 47 toward the downward direction side is restricted by each of the locking protrusions 27. The movement of the detection member 40 toward the downward direction side with respect to the lock arm 31 (the housing 20) at the fixing position is restricted by the respective locking protrusions 27 and the respective ribs 47. At that time, the respective locking protrusions 27 and the respective ribs 47 may come into contact with each other in the opposing direction, or may be arranged with an interval therebetween in the opposing direction.

Next, the engagement between the connector 1 and the counterpart connector C will be described. The connector 1 is moved in the engagement direction such that the counterpart housing Ch is inserted into the annular space 23 of the housing 20 in a state where the detection member 40 is at the fixing position as illustrated in FIG. 4. When the connector 1 moves in the engagement direction, the locking portion 31*b* and the locked portion 32*a* abut on each other. After the locking portion 31*b* and the locked portion 32*a* abut on each other, the locking portion 31*b* is pushed in the upward direction by the locked portion 32*a* as the connector 1 continues to move in the engagement direction, and the locked portion 32*a* passes over the locking portion 31*b* until reaching the complete engagement state while bending the lock arm 31. In addition, the worker or the like may move continuously move the connector 1 in the engagement direction so that the locked portion 32*a* is moved to the position to form the complete engagement state after the locking portion 31*b* of the lock arm 31 is bent in the upward direction.

After the locked portion 32*a* pushes the locking portion 31*b* in the upward direction, the distal end 42*a* of the detection arm 42 comes into contact with the locked portion 32*a* as the connector 1 continues to move in the engagement direction. As the movement progresses, the locked portion 32*a* applies a force directed in the upward direction to the distal end 42*a*. At that time, the detection arm 42 begins to deflect with the base on the detachment direction side as a fulcrum, in the detection member 40.

Figure 13:
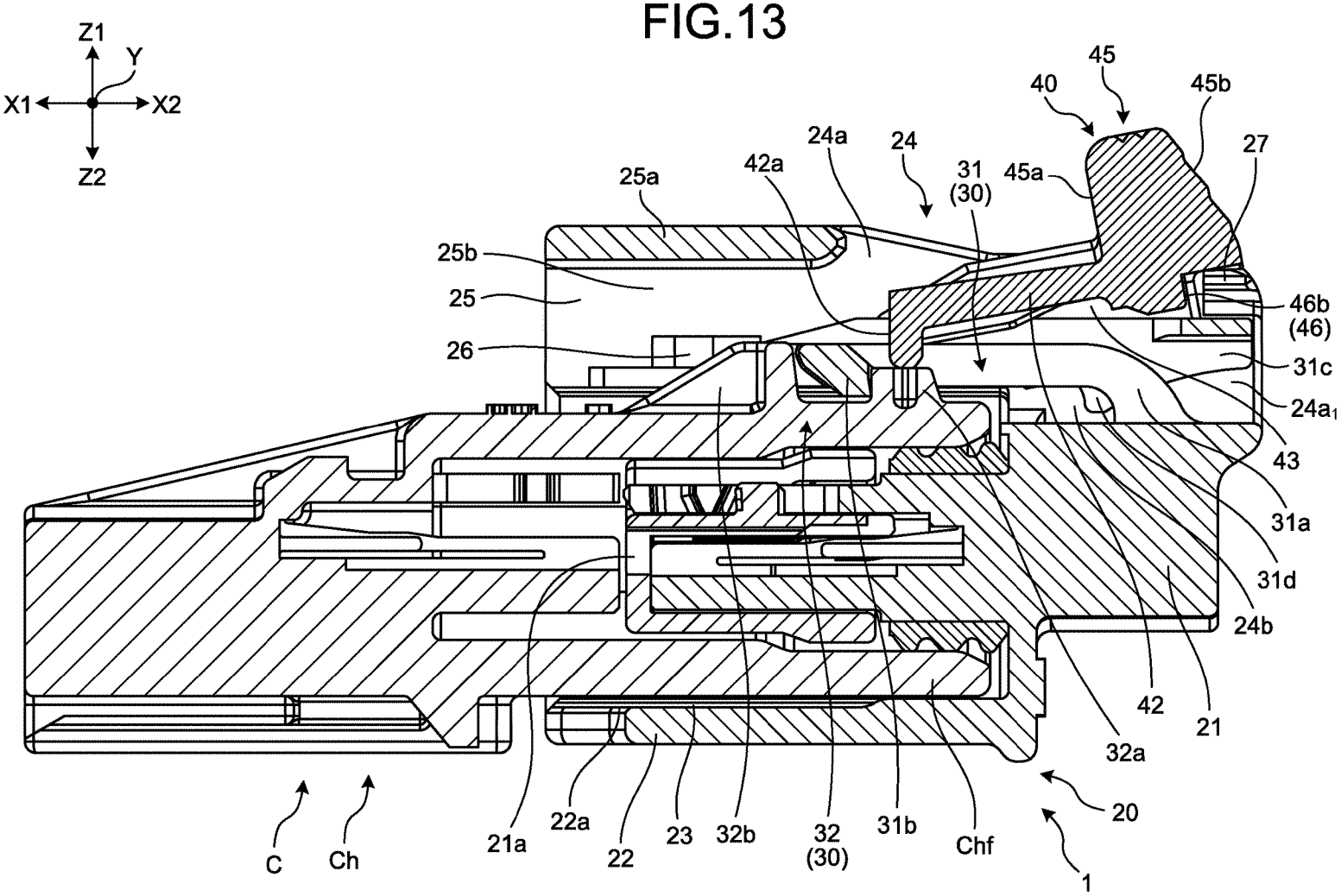
FIG. 13 is a cross-sectional view taken along a line Z-Z of FIG. 12.

At the position to form the complete engagement state, the lock arm 31 that has deflected returns to the original position, and the locking portion 31*b* and the locked portion 32*a* face each other in the insertion and removal direction as illustrated in FIG. 13. Since a removal operation between the connector 1 and the counterpart connector C is suppressed in the holding structure 30, the connectors are held in the complete engagement state. In addition, in the detection member 40, the detection arm 42 deflects up to a position at which the distal end 42*a* can pass over the locking portion 31*b*.

As illustrated in FIG. 13, the locking portion 31*b* of the lock arm 31 approaches the release operating portion 32*b* by being moved in the engagement direction to the position to form the complete engagement state. The movement of the locking portion 31*b* toward the engagement direction side is locked by the end of the release operating portion 32*b* by reducing an interval at the position to form the complete engagement state between the locking portion 31*b* and the release operating portion 32*b*. The movement of the lock arm 31 toward the engagement direction side in the complete engagement state is restricted by using the locking portion 31*b* and the end portion of the release operating portion 32*b*.

The relative movement of the detection member 40 from the fixing position to the main locking position will be described. As illustrated in FIG. 13, the detection member 40 relatively moves with respect to the housing 20 from the fixing position to the main locking position by moving the distal end 42*a* beyond the locking portion 31*b* toward the engagement direction in the state where the detection member 40 is at the fixing position in the complete engagement state. As a result, the detection arm 42 is positioned between the lock wall 25*a* and the locking portion 31*b*. As illustrated in FIG. 6, the distal end 42*a* is separated from the release operating portion 32*b* until the detection member 40 moves to the main locking position after the locking state of the distal end 42*a* is released, and thus, the deflection of the detection arm 42 is gradually resolved.

Figure 9:
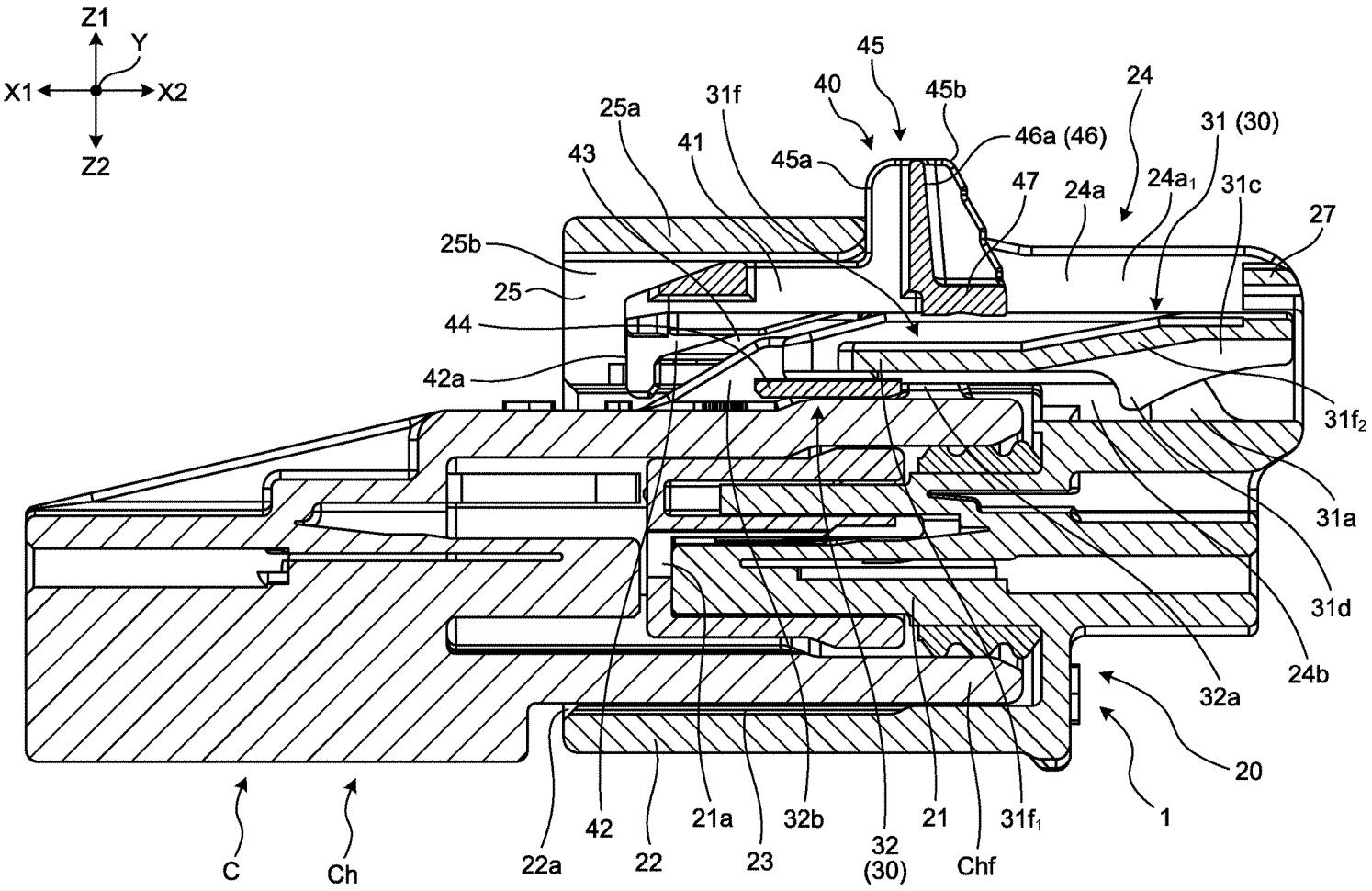
FIG. 9 is a cross-sectional view taken along a line Y1-Y1 of FIG. 5.
Figure 14:
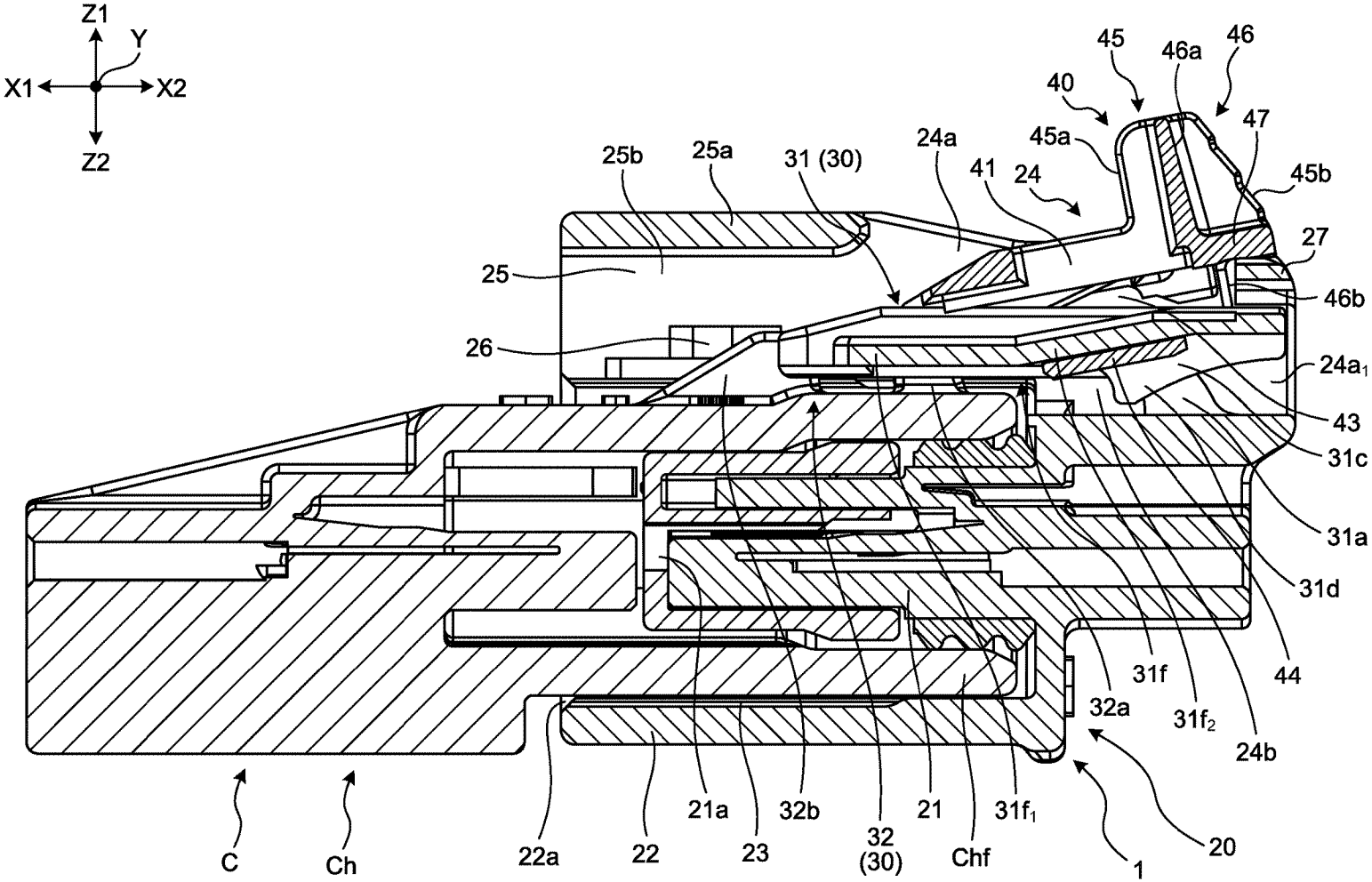
FIG. 14 is a cross-sectional view taken along a line Z1-Z1 of FIG. 12.
Figure 16:
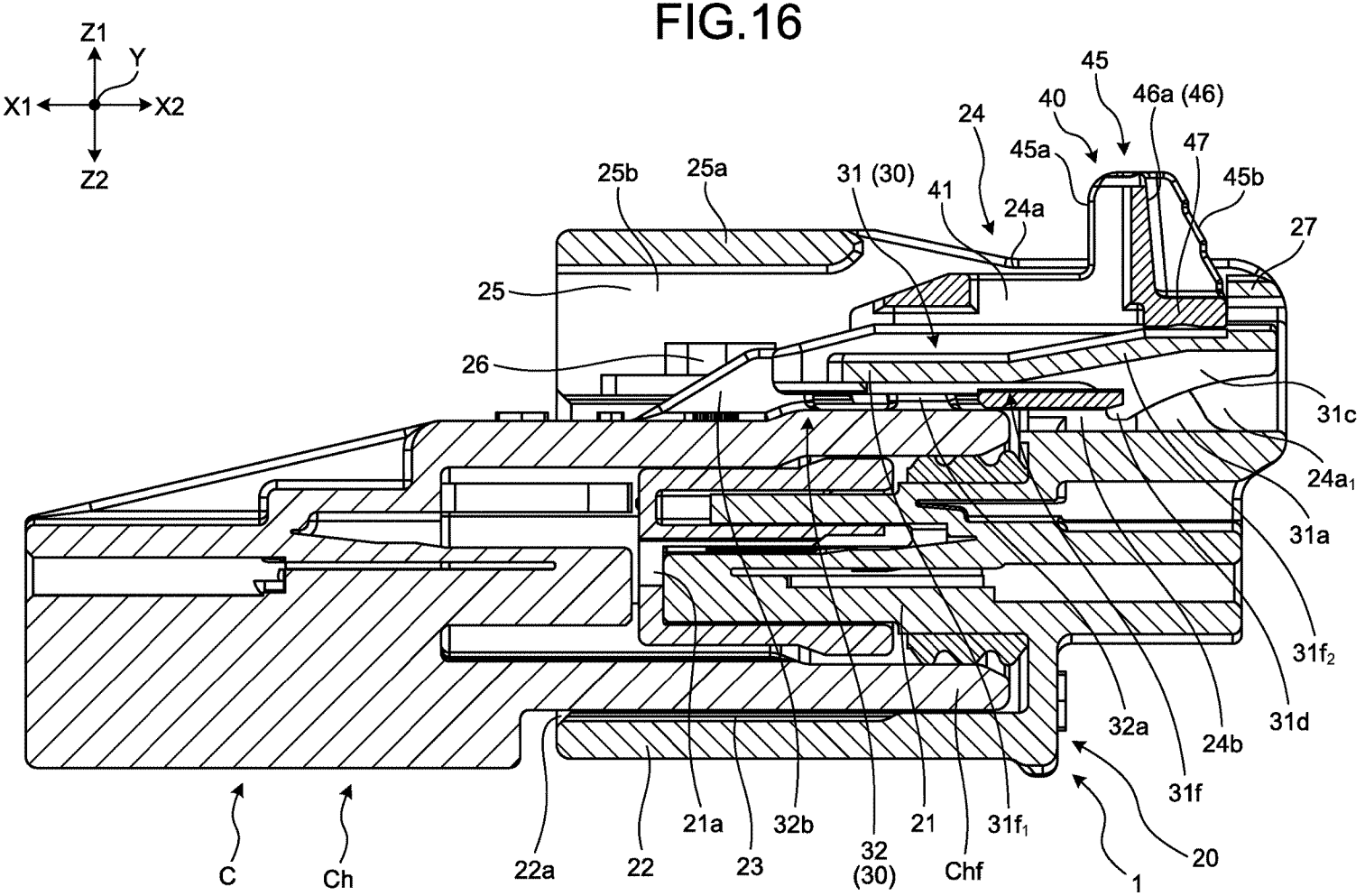
FIG. 16 is a view illustrating a state in the course of movement of the detection member from the fixing position in FIG. 14 to the main locking position.

In addition, a groove, surrounded by the base body 41, the wall body 43, and the protruding body 44, is formed at the end portion on the side wall 24*a*1 side of the detection member 40 along the insertion and removal direction. When being assembled to the lock arm 31, the detection member 40 is held by the lock arm 31 as the lock arm 31 is accommodated in the groove of the detection member 40. With the above-described configuration, it is possible to perform guidance when the detection member 40 relatively moves in the insertion and removal direction with respect to the lock arm 31, and to suppress the detachment of the detection member 40 from the lock arm 31 (detachment in a direction different from the relative movement direction) as illustrated in FIG. 16. The protruding body 44 is positioned so as to oppose the inclined portion 31*f*2 of the guide rail 31*f* at the fixing position as illustrated in FIG. 14, and is positioned so as to oppose the straight portion 31*f*1 of the guide rail 31*f* at the main locking position as illustrated in FIG. 9.

Figure 15:
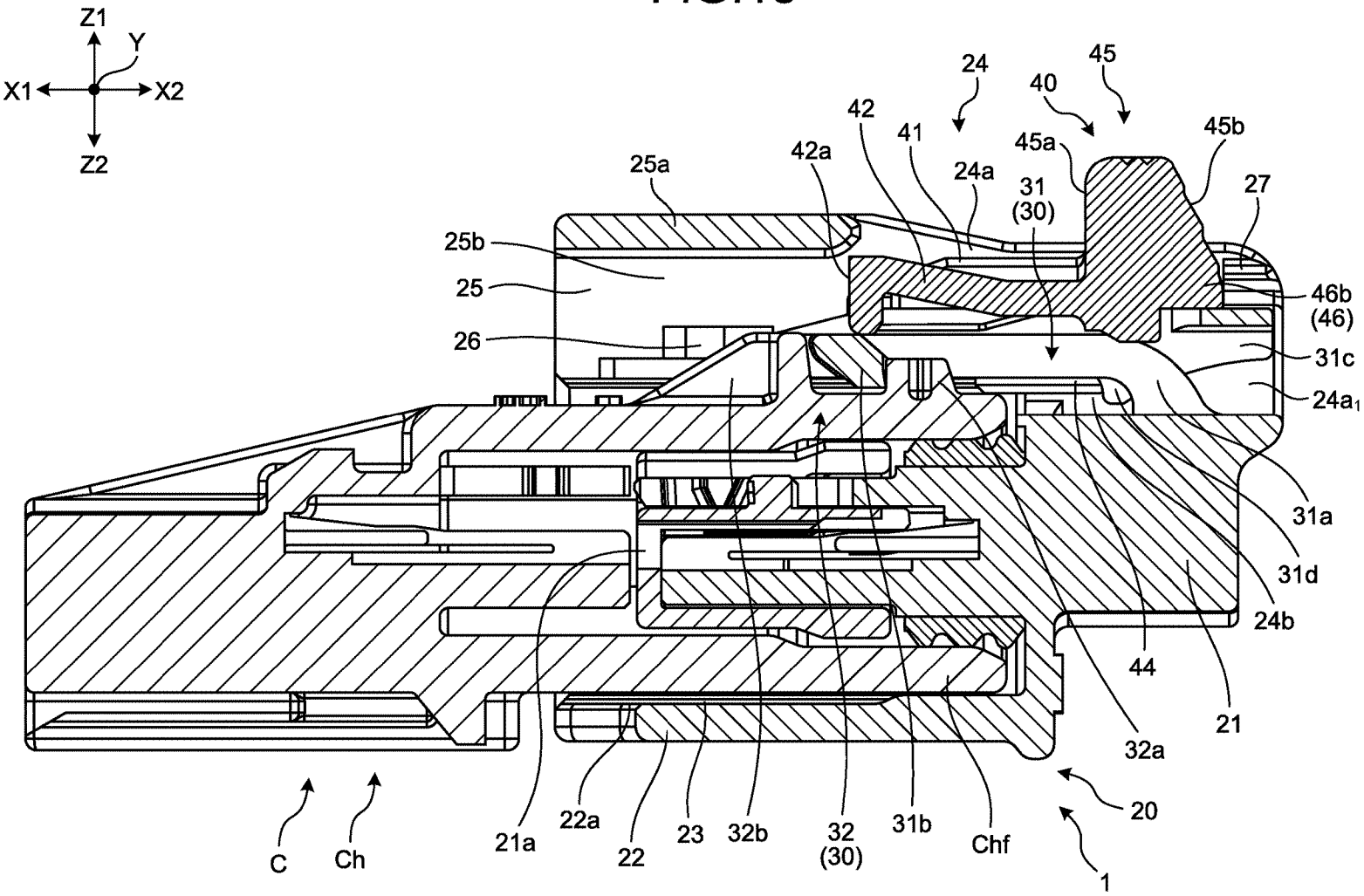
FIG. 15 is a view illustrating a state in the course of movement of the detection member from the fixing position in FIG. 13 to the main locking position.

The relative movement of the detection member 40 from the main locking position to the temporary locking position will be described. As the worker pulls the release operation surface 45*a* in the detachment direction with a finger to move the detection member in the detachment direction in the state where the detection member 40 is at the main locking position, the distal end 42*a* comes into contact with the release operating portion 32*b* along with the progress of the movement as illustrated in FIG. 6. As the release progresses, the release operating portion 32*b* applies a force directed in the upward direction to the distal end 42*a*. At that time, the detection arm 42 begins to deflect with the base on the detachment direction side as a fulcrum, in the detection member 40. In this detection member 40, the release further progresses, and the detection arm 42 deflects up to a position at which the distal end 42*a* can pass over the release operating portion 32*b* as illustrated in FIG. 15. The detection member 40 relatively moves with respect to the housing 20 from the main locking position to the temporary locking position by moving the distal end 42*a* over the release operating portion 32*b* toward the detachment direction side. Incidentally, the protruding body 44 is positioned so as to oppose the inclined portion 31*f*2 of the guide rail 31*f* at the temporary locking position as illustrated in FIG. 11.

The release of the complete engagement state in the connector 1 and the counterpart connector C will be described. As the worker continues to pull the release operation surface 45*a* in the detachment direction in the state where the detection member 40 is at the main locking position, the support portion 31*d* of the lock arm 31 is lowered and abuts on the main body 21 of the housing 20 as illustrated in FIG. 6. As the release operation surface 45*a* is further pulled after the abutment, the release lever portion 31*c* of the lock arm 31 rotates about a fulcrum which is a contact point between the support portion 31*d* and the main body 21 by leverage, so that the detection member operating portion 45 moves in the detachment direction and the downward direction. As a result, the locking portion 31*b* connected to one end on the engagement direction side of the release lever portion 31*c* deflects in the upward direction, so that the locking portion 31*b* and the locked portion 32*a* do not face each other in the insertion and removal direction. Thus, the complete engagement state of the connector 1 and the counterpart connector C can be released by continuing to pull the release operation surface 45*a*, thereby forming the main locking state. Incidentally, the detection member operating portion 45 opposes the main body 21 with the support portion 31*d* sandwiched therebetween and is positioned on the detachment direction side of the locking portion 31*b* in a half-engagement state.

According to the connector 1 described above, the detection member 40 can be held by the housing 20 in the state of being attached to the lock arm 31, before at least the engagement state becomes the complete engagement state, at the fixing position at which the distal end 42*a* of the detection arm 42 opposes the locking portion 31*b* in the engagement direction, the locking protrusion 27 is sandwiched between the rib 47 and the main body 21, and the protruding body 44 is positioned so as to oppose a part on the detachment direction side of the guide rail 31*f*. As a result, the lock arm 31 is in the state of being held, and thus, it is possible to suppress the deformation of the lock arm caused by the external force or the electric wire being caught as in the conventional connector. That is, when the lock arm 31 is in the free state, the detection member 40 is held by the housing 20 even if a load to cause deformation beyond the deformation of the lock arm 31 that can be elastically restored is applied. Thus, it is possible to suppress the deformation of the lock arm 31 and to sufficiently secure a holding force after connector engagement without being turned into a deformation state where the lock arm 31 is likely to be plastically deformed.

In addition, the protruding body 44 of the detection member 40 holds the guide rail 31*f* so as to restrict the deformation of the lock arm 31 in the vertical direction. Since the guide rail 31*f* is held such that the protruding body 44 of the detection member 40 opposes a part of the guide rail 31*f* on the detachment direction side formed toward the direction away from the main body 21 at the fixing position, it is possible to increase relative movement between the detection member 40 and the lock arm 31 in the opposing direction as compared with the main locking position. The lock arm 31 can be held with a small bending amount even if the detection member 40 rides over the locking protrusion 27 of the housing 20.

In addition, the guide rail 31*f* has the inclined portion 31*f*2 that faces the direction away from the main body 21 as a part of the guide rail 31*f* proceeds in the detachment direction, and the protruding body 44 of the detection member 40 moves so as to oppose the inclined portion 31*f*2, so that it is possible to smoothly move the detection member 40 from the fixing position to the main locking position.

In addition, the lock arm 31 has the locked body 31*g* positioned so as to be sandwiched between the main body 21 and the locking protrusion 27. For example, the locked body 31*g* abuts on the locking protrusion 27 at the main locking position and the temporary locking position even if the load to cause the deformation beyond the deformation of the lock arm 31 that can be elastically restored is applied, and thus, it is possible to suppress the deformation of the lock arm 31.

In addition, the guide rail 31*f* has the inclined portion 31*f*2 facing the direction away from the main body 21 as a part on the detachment direction side proceeds in the detachment direction in the above embodiment, but the invention is not limited thereto. For example, the part of the detachment direction side may be formed so as to face the direction away from the main body 21.

In addition, the lock arm has the locked body 31*g* positioned so as to be sandwiched between the main body 21 and the locking protrusion 27 in the above embodiment, but the invention is not limited thereto. For example, the release lever portion 31*c* of the lock arm may be positioned so as to be sandwiched between the main body 21 and the locking protrusion 27.

In addition, the locking protrusion 27 is provided at the rear end of the housing 20 in the above embodiment, but the invention is not limited thereto, and may be provided on the engagement direction side of the rear end of the housing 20, for example.

In addition, a lock arm operating portion may be formed in the release lever portion 31*c* in the above embodiment. As a result, it is possible to release the locking of both the housings without the detection member 40 by operating the lock arm operating portion.

In addition, the guide rails 31*f* are provided at positions opposing the respective side walls 24*a*1 of the release lever portion 31*c* in the above embodiment, but the invention is not limited thereto. The guide rails 31*f* may be portions of the release lever portion 31*c*, which protrude so as to oppose the side walls 24*a*1, respectively, that is, both side walls of the lock arm 31. In this case, the guide rails 31*f* is portions forming the release lever portion 31*c* out of both the side walls of the lock arm 31.

In addition, the lock arm 31 is fixed to the main body 21 at the base portion 31*a*, that is, is formed as a cantilever with respect to the main body 21 in the above embodiment, but the invention is not limited thereto. For example, a support portion to be fixed to the main body 21 may be formed at the center of the lock arm 31 in the insertion and removal direction, the locking portion 31*b* may be formed at the end in the engagement direction, and a portion of the lock arm 31 on the detachment direction side of the support portion may be used as the release lever portion 31*c*.

In addition, the locking protrusion 27 is formed to be flat in the insertion and removal direction in the above embodiment, but the invention is not limited thereto. The locking protrusion 27 may have a restriction protrusion that protrudes in the upward direction at the end on the detachment direction side. In this case, the restriction protrusions are positioned on the detachment direction side of the ribs 47 riding on the locking protrusions 27, respectively, in the state where the detection member 40 is at the fixing position. That is, when the detection member 40 is at the fixing position, the two pairs of the ribs 47 and the locking protrusion 27 oppose each other in the insertion and removal direction, and thus, it is possible to suppress turning of the detection member 40 as the detection member 40 moves in the detachment direction with respect to the housing 20, that is, detachment of the detection member 40 from the housing 20.

In addition, it is preferable that the locking protrusion 27 and the rib 47 be in surface contact with each other in the state where the detection member 40 is at the fixing position in the above embodiment in order to suppress the turning of the detection member 40 as the detection member 40 moves in the detachment direction with respect to the housing 20, that is, the detachment of the detection member 40 from the housing 20. The end of the base body 41 on the detachment direction side is positioned in the upward direction of the end of the engagement direction side in the detection member 40 at the fixing position as compared to the detection member 40 at the other position, and the base body 41 is in the state of being inclined with respect to the insertion and removal direction such that the end on the detachment direction side is positioned in the upward direction. Therefore, when upper surfaces of the locking protrusions 27 in the vertical direction are parallel to the insertion and removal direction as viewed from the width direction, lower surfaces of the ribs 47 in the vertical direction are formed to be parallel in the insertion and removal direction in the state where the detection member 40 is at the fixing position. Alternatively, when the lower surfaces of the ribs 47 in the vertical direction are parallel in the insertion and removal direction in a state where the detection member 40 is at a position other than the fixing position as viewed from the width direction, the upper surfaces of the locking protrusions 27 in the vertical direction are formed to be parallel to the lower surfaces of the ribs 47 in the state where the detection member 40 is at the fixing position.

The connector according to the present embodiment has an effect that it is possible to sufficiently secure the holding force in the engagement state after engagement of both the connectors.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal;

a housing in which the terminal is accommodated and held and to which a counterpart housing is locked by causing a locking portion to be locked by a locked portion provided in the counterpart housing to perform releasable locking when an engagement state with the counterpart connector is in a complete engagement state; and a detection member that is assembled to the housing and capable of relative movement in an engagement direction and a detachment direction with respect to the housing between a temporary locking position and a main locking position when the engagement state is the complete engagement state, wherein the housing includes:

a main body;

a lock wall opposing the main body in an opposing direction, which is a direction orthogonal to the engagement direction, and sandwiching the locking portion together with the main body at the main locking position;

a flexible lock arm fixed to the main body;

a pair of side walls erected from the main body in the opposing direction and opposing each other in an arrangement direction orthogonal to the engagement direction and the opposing direction while sandwiching the lock arm; and a pair of locking protrusions protruding from each of the side walls toward the other side wall, and the detection member is attachable to the lock arm, the lock arm includes:

a locking portion; and a pair of guide rails protruding toward the side walls, respectively, extending in the detachment direction, and formed to have a part on a side in the detachment direction facing a direction away from the main body, the detection member includes:

a base body;

a flexible detection arm protruding from the base body in the engagement direction and positioned such that a distal end opposes the locking portion in the detachment direction at the temporary locking position and that the distal end opposes the locking portion in the engagement direction at the main locking position;

a pair of wall bodies erected from the base body in the opposing direction and opposing each other in the arrangement direction;

a pair of protruding bodies each of which protrudes from each of the wall bodies toward the other wall body and is positioned to be sandwiched between the main body and the guide rail when the detection member is attached to the lock arm;

an abutment surface provided on a side of the detection member in the detachment direction and orthogonal to the engagement direction; and a rib positioned on a side in the detachment direction of the abutment surface, positioned to be sandwiched between the main body and the locking protrusion at the main locking position as viewed from the engagement direction, and positioned to be sandwiched between the main body and the locking protrusion at the temporary locking position, at least a part of the detection member is positioned between the lock wall and the locking portion at the main locking position, and the detection member is relatively movable with respect to the housing between a fixing position and the main locking position at least before the engagement state becomes the complete engagement state, the fixing position at which the distal end of the detection arm opposes the locking portion in the engagement direction, the locking protrusion is sandwiched between the rib and the main body while opposing the abutment surface in an insertion and removal direction, and the protruding body is positioned to oppose the part of the guide rail on the side in the detachment direction.

2. The connector according to claim 1, wherein the guide rail has an inclined portion that faces a direction away from the main body as the part on the side in the detachment direction proceeds in the detachment direction.

3. The connector according to claim 1, wherein the lock arm includes a locked body positioned to be sandwiched between the main body and the locking protrusion.

4. The connector according to claim 2, wherein the lock arm includes a locked body positioned to be sandwiched between the main body and the locking protrusion.

* * * * *